US010559881B2

(12) United States Patent
Sakita et al.

(10) Patent No.: US 10,559,881 B2
(45) Date of Patent: Feb. 11, 2020

(54) WIRELESS COMMUNICATION DEVICE

(71) Applicant: FUJITSU CONNECTED TECHNOLOGIES LIMITED, Kawasaki-shi, Kanagawa (JP)

(72) Inventors: Satoshi Sakita, Kawasaki (JP); Minoru Sakurai, Kawasaki (JP); Tabito Tonooka, Kawasaki (JP)

(73) Assignee: FUJITSU CONNECTED TECHNOLOGIES LIMITED, Kawasaki (JP)

( * ) Notice: Subject to any disclaimer, the term of this patent is extended or adjusted under 35 U.S.C. 154(b) by 0 days.

(21) Appl. No.: 16/155,384

(22) Filed: Oct. 9, 2018

(65) Prior Publication Data

US 2019/0115662 A1 Apr. 18, 2019

(30) Foreign Application Priority Data

Oct. 12, 2017 (JP) ..... 2017-198541

(51) Int. Cl.
*H01Q 21/28* (2006.01)
*H01Q 5/357* (2015.01)
(Continued)

(52) U.S. Cl.
CPC ..... *H01Q 5/357* (2015.01); *H01Q 1/243* (2013.01); *H01Q 1/48* (2013.01); *H01Q 5/335* (2015.01);
(Continued)

(58) Field of Classification Search
CPC .. H01Q 5/35; H01Q 5/33; H01Q 5/37; H01Q 1/24; H01Q 1/48; H01Q 9/04; H01Q 9/30; H01Q 11/04; H01Q 21/28
(Continued)

(56) References Cited

U.S. PATENT DOCUMENTS

2007/0210965 A1* 9/2007 Takada ..... H01Q 1/243 343/700 MS
2008/0266190 A1 10/2008 Ohba et al.
2012/0013511 A1 1/2012 Sumi et al.
2015/0155614 A1 6/2015 Youn et al.
2017/0230073 A1 8/2017 Youn et al.
(Continued)

FOREIGN PATENT DOCUMENTS

JP 10-51233 A 2/1998
JP 2004-40596 A 2/2004
(Continued)

*Primary Examiner* — Andrea Lindgren Baltzell

(74) *Attorney, Agent, or Firm* — Westerman, Hattori, Daniels & Adrian, LLP

(57) ABSTRACT

The wireless communication device has a first radiation element, which includes a first line path being extended between a first end and a second end and performs communication at a first frequency. The device also has a second radiating element coupled to the first radiating element and resonating at a second frequency, which element has a second line path extending from a first connecting portion connected to the sheet metal to a third end portion near the first end portion, and a third path line extending from an intermediate point between the first connecting portion and the third end portion to the fourth end portion. And a power supply circuit for a third frequency is connected to the fourth end via a cutoff circuit which cuts off the second frequency. With this configuration, the wireless communication device enables the communication in more frequency bands.

10 Claims, 15 Drawing Sheets

(51) Int. Cl.

| | |
|---|---|
| ***H01Q 11/04*** | (2006.01) |
| ***H01Q 1/24*** | (2006.01) |
| ***H01Q 9/04*** | (2006.01) |
| ***H01Q 9/30*** | (2006.01) |
| ***H01Q 5/335*** | (2015.01) |
| ***H01Q 5/371*** | (2015.01) |
| ***H01Q 1/48*** | (2006.01) |

(52) U.S. Cl.
CPC ..... *H01Q 5/371* (2015.01); *H01Q 9/0407* (2013.01); *H01Q 9/30* (2013.01); *H01Q 11/04* (2013.01); *H01Q 21/28* (2013.01)

(58) Field of Classification Search
USPC ..... 343/700 MS
See application file for complete search history.

(56) References Cited

U.S. PATENT DOCUMENTS

| | | | |
|---|---|---|---|
| 2018/0041239 | A1 | 2/2018 | Youn et al. |
| 2018/0241430 | A1 | 8/2018 | Youn et al. |

FOREIGN PATENT DOCUMENTS

| | | | |
|---|---|---|---|
| JP | 2004-64312 | A | 2/2004 |
| JP | 2007-243836 | A | 9/2007 |
| JP | 2008-278219 | A | 11/2008 |
| JP | 2011-120071 | A | 6/2011 |
| JP | 2015-109642 | A | 6/2015 |
| WO | 2010/035317 | A1 | 4/2010 |
| WO | 2012/160820 | A1 | 11/2012 |

* cited by examiner

WIRELESS COMMUNICATION DEVICE

CROSS-REFERENCE TO RELATED APPLICATION

This application is based upon and claims the benefit of priority of the prior Japanese Patent Application No. 2017-198541, filed on Oct. 12, 2017, the entire contents of which are incorporated herein by reference.

FIELD

The embodiments discussed herein are related to a wireless communication device.

BACKGROUND

There has been a conventional mobile terminal including: a metal frame including a base section and a frame section formed along the contour of the base section; a first case and a second case respectively coupled to the front surface and the back surface of the metal frame so that the frame section is externally exposed; and first and second waterproofing layers provided between the first and second cases, and the metal frame.

The mobile terminal is characterized that operates as radiators of antenna along with the frame part and further includes: multiple conductive members formed on one surface of the second case; and multiple power feed units that feed power to the multiple conductive members respectively; and the multiple power feed units are disposed in an enclosed space formed by the waterproofing layers (see, for example, Japanese Laid-open Patent Publication No. 2015-109642).

SUMMARY

A wireless communication device of embodiments of the present disclosure including: a ground plane that has a first end side and is disposed inside a housing; a first radiation element that is fed with power at a power feed point located in a vicinity of the first end side, has a first line path which is exposed to an outer peripheral portion of the housing and extends between a first end and a second end, and performs communication at a first communication frequency; a sheet metal connected to the ground plane; a second radiation element that includes a second line path and a third line path, and is coupled to the first radiation element and resonates with a second communication frequency, the second line path being exposed from a first connection portion connected to the sheet metal to the outer peripheral portion of the housing, and extending to a third end located in a vicinity of the first end, the third line path extending from a first point between the first connection portion and the third end of the second line path to a fourth end located internally of the housing, a length of the second line path being a quarter wavelength of an electrical length of a second wave length of the second communication frequency, one of a first length from the third end to the fourth end through the first point and a second length from the first connection portion to the fourth end through the first point being a quarter wavelength of an electrical length of a third wave length of a third communication frequency; a first cutoff circuit that is connected to the fourth end and cuts off the second communication frequency; and a first power feed circuit that is connected to the fourth end via the first cutoff circuit, and feeds power at the third communication frequency to the fourth end.

The object and advantages of the invention will be realized and attained by means of the elements and combinations particularly pointed out in the claims.

It is to be understood that both the foregoing general description and the following detailed description are exemplary and explanatory and are not restrictive of the invention.

DETAILED DESCRIPTION OF THE EMBODIMENT

Hereinafter, an embodiment to which a wireless communication device of the present disclosure is applied will be described.

Embodiment

Figure 1:
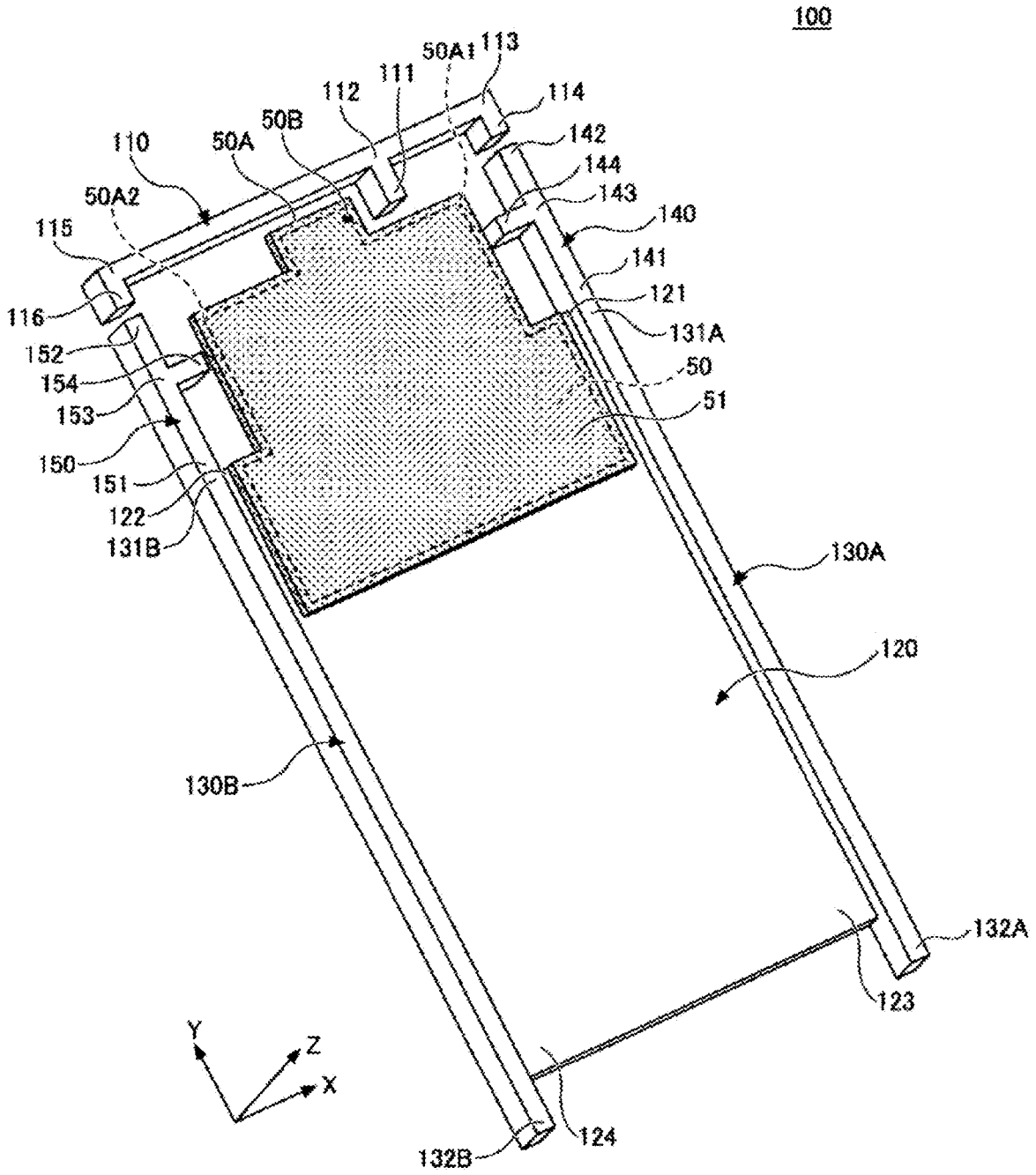
FIG. 1 is a view depicting a wireless communication device of Embodiment.
Figure 2:
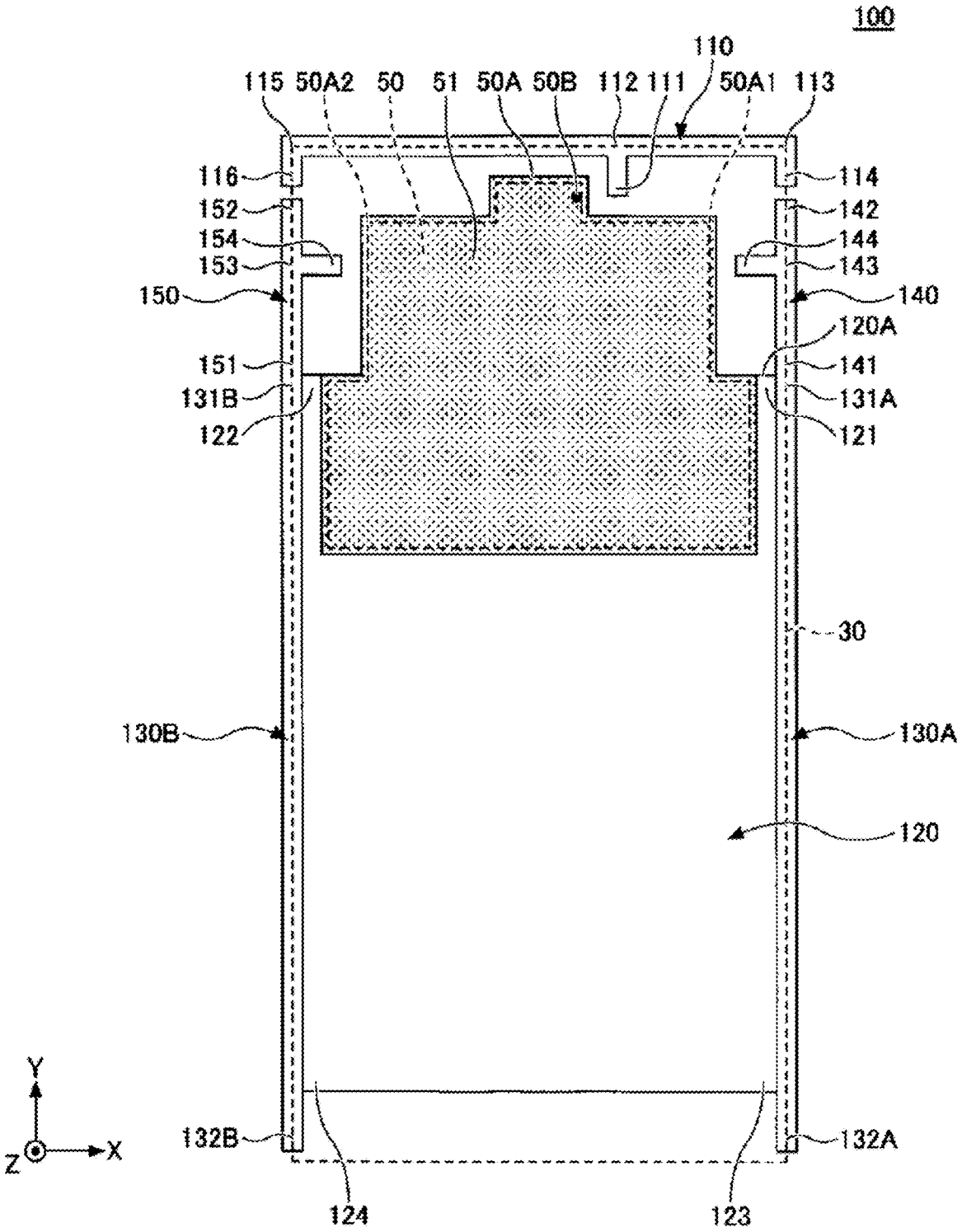
FIG. 2 is a view depicting a wireless communication device of Embodiment.
Figure 3:
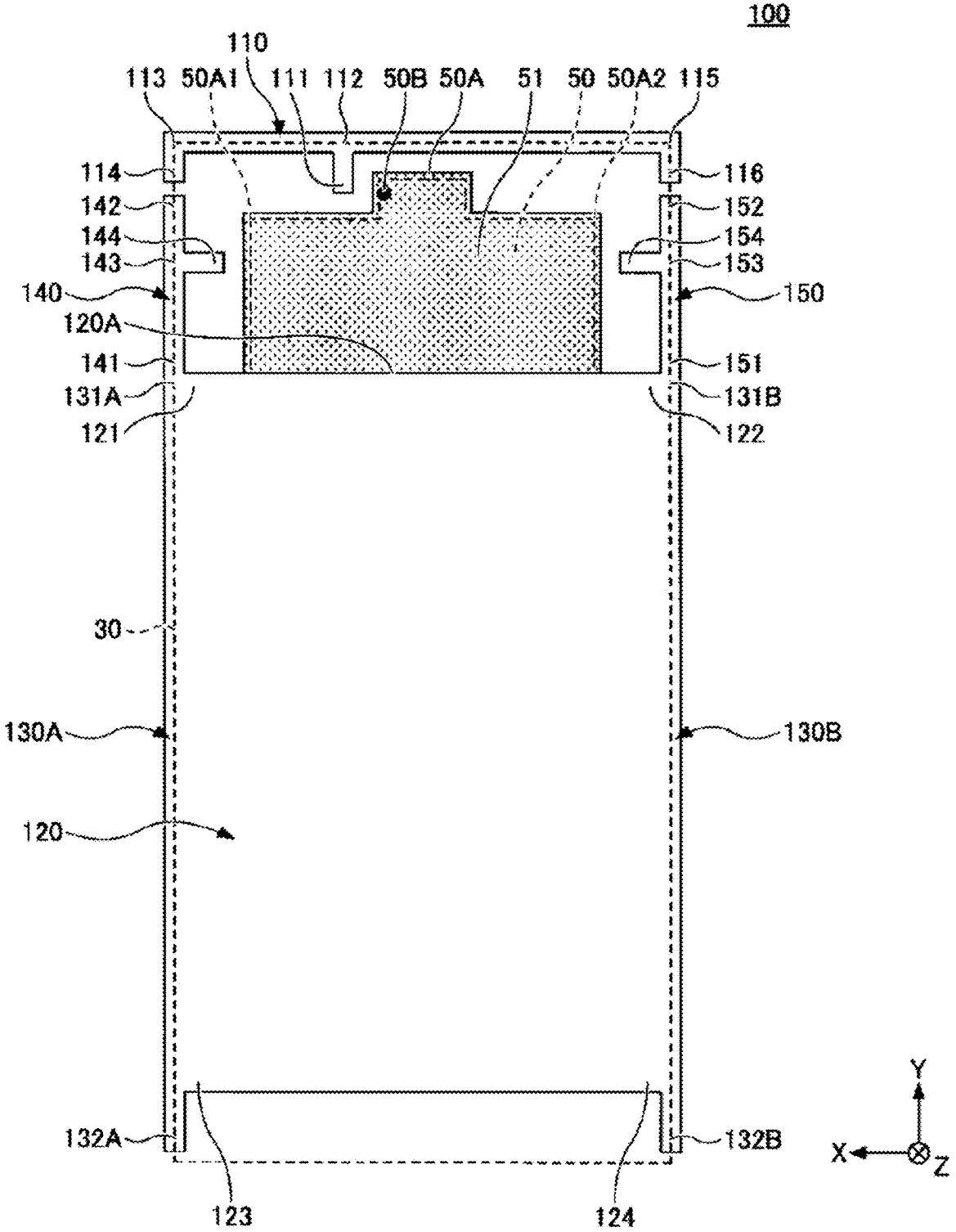
FIG. 3 is a view depicting a wireless communication device of Embodiment.

FIGS. 1 to 3 illustrate a wireless communication device 100 of the embodiment. Hereinafter a description is given with the XYZ coordinate system defined. FIG. 1 is a perspective view, FIG. 2 is a view from the positive Z-axis direction side, and FIG. 3 is a view from the negative Z-axis direction side. Also, hereinafter XY plan view is referred to as a plan view.

Figure 4:
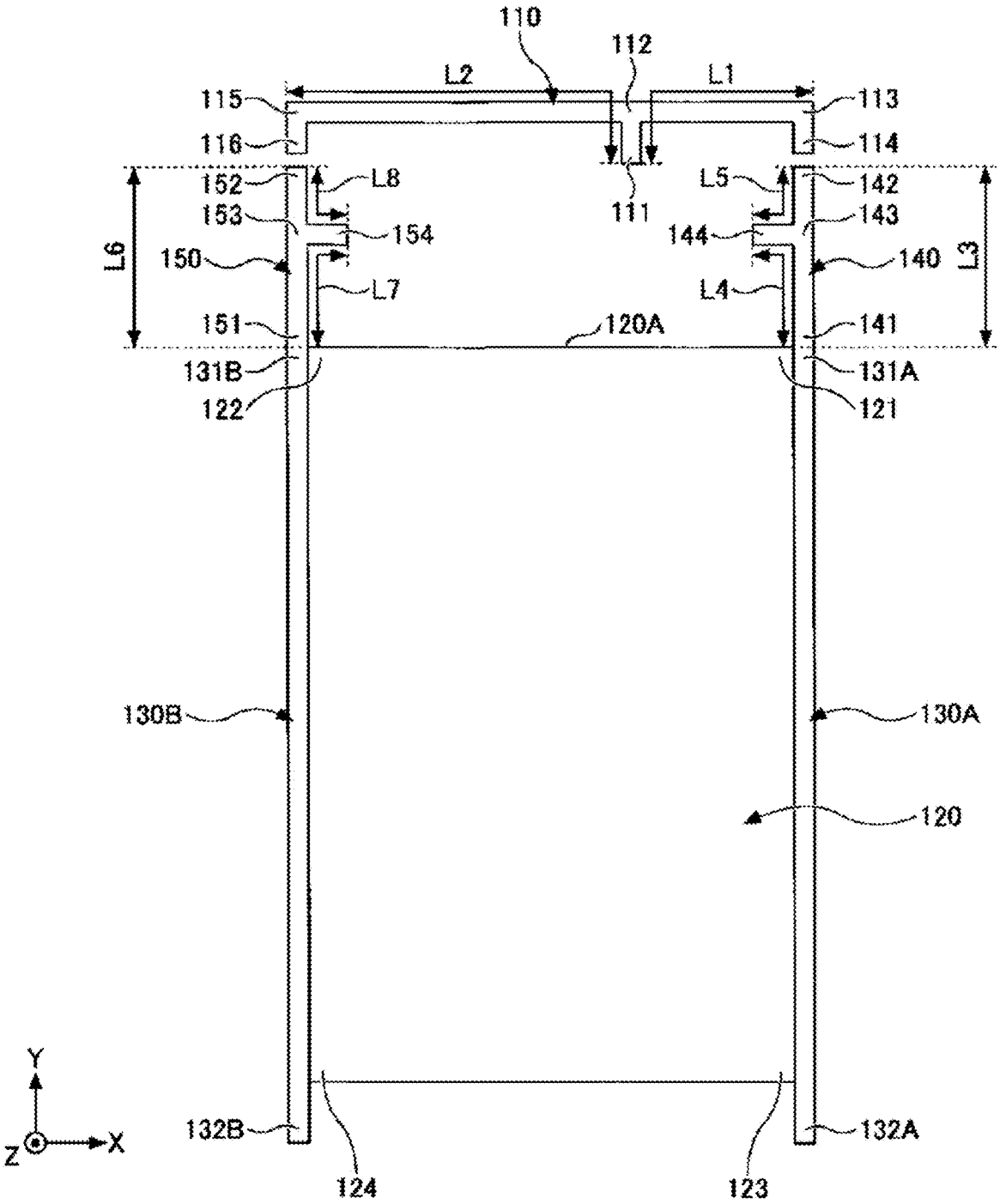
FIG. 4 is a view illustrating the state where the housing and the ground plane are removed from FIG. 2.

The wireless communication device 100 includes a housing 30, a ground plane 50, a radiation element 110, a sheet metal 120, metal plates 130A, 130B, a radiation element 140, and a radiation element 150. Among these components, for the housing 30, a illustration is omitted in FIG. 1, and the outline is illustrated in FIGS. 2 and 3. Hereinafter a description is given with reference to FIG. 4 in addition to FIGS. 1 to 3. FIG. 4 is a view illustrating the state where the housing 30 and the ground plane 50 are removed from FIG. 2.

Hereinafter an embodiment in which the wireless communication device 100 performs communication in eight communication frequencies f1 to f8 will be described. The communication frequencies f1 to f8 each indicate a frequency band including a resonance frequency.

The wireless communication device 100 is a device that is included in an electronic device, such as a smartphone terminal, a mobile phone terminal, a tablet computer, a game machine, and etc., and that performs data communication with multiple frequency bands. Here, a description is given under the assumption that the wireless communication device 100 includes the housing 30. However, the wireless communication device 100 not including the housing 30 may be applicable.

The housing 30 is the housing of the above-described electronic device. The housing 30 may be, for instance, made of resin or made of glass, or may include a portion made of resin and a portion made of glass. The housing 30 is rectangular in a plan view, thin in the Z-axis direction, and is substantially a thin plate-shaped member extending along the XY plane.

In the housing 30, the front surface side is the side on which a surface extending along the XY plane on the positive Z-axis direction side is located, the back surface side is the side on which a surface extending along the XY plane on the negative Z-axis direction side is located, and the lateral surfaces are each a small width surface that connects the front surface with the back surface. Each lateral surface of the housing 30 is a surface that extends along the XZ plane or the YZ plane of the substantially thin plate-shaped housing 30.

A portion of each of the radiation element 110, the metal plates 130A, 130B, the radiation element 140, and the radiation element 150 is exposed from the lateral surfaces of the housing 30. One of the reasons why a portion of each of the radiation element 110, the metal plates 130A, 130B, the radiation element 140, and the radiation element 150 is exposed from the lateral surfaces of the housing 30 is to maximize the radiation efficiency of communication power when the wireless communication device 100 performs communication.

The ground plane 50 is provided at an end on the positive Y-axis direction side within the housing 30, and extends along the XY plane. The ground plane 50 is a metal layer disposed in the front surface, the back surface, or an inner layer of a wiring board 51 in conformity with, for instance, the Flame Retardant type 4 (FR-4) standard. The ground plane 50 is held at a reference potential. The reference potential is the ground potential as an example. The ground plane 50 may be treated as a ground plate or an earth plate.

The ground plane 50 has an end side 50A on the positive Y-axis direction side. The end side 50A is the side with both ends at end points 50A1, 50A2. The end side 50A is not linear in the X-axis direction, and is bulged such that a central portion in the X-axis direction projects in the Y-axis direction. The end side 50A is an example of a first end side.

A power feed point 111 of the radiation element 110 is located in the vicinity the end side 50A, and a corresponding point 50B is provided in the vicinity the power feed point 111. A power feed line path, which is provided in the wiring board 51 and feeds power to the power feed point 111, passes through the corresponding point 50B in a plan view. The power feed line path is a micro strip line, for instance.

The radiation element 110 is a T-shaped antenna element having the power feed point 111, a branch point 112, a bent portion 113, an end 114, a bent portion 115, and an end 116. The radiation element 110 is an example of a first radiation element. The power feed point 111 is electrically connected, for instance, by a micro strip line which passes through the corresponding point 50B. The power feed point 111 is connected to an impedance component such as a coil or a capacitor, and the impedance of the power feed point 111 is adjusted to 50Ω as an example.

The radiation element 110 extends in the Y-axis direction from the power feed point 111 to the branch point 112, extends from the branch point 112 to the bent portion 113 in the positive X-axis direction, and extends in the negative Y-axis direction from the bent portion 113 to the end 114 as well as extends from the branch point 112 to the bent portion 115 in the negative X-axis direction, and extends in the negative Y-axis direction from the bent portion 115 to the end 116.

Also, the section from the end 114 to the end 116 through the bent portion 113, the branch point 112, and the bent portion 115 is exposed to lateral surfaces of the housing 30. Here, the section between the end 114 and the end 116 is exposed to lateral surfaces of the housing 30 indicates that the section between the end 114 and the end 116 of the radiation element 110 is visible from the outside of the lateral surfaces of the housing 30, and a part of the lateral surfaces, along the XY plane, of the radiation element 110 may appear outside of the housing 30 as the housing 30 in which the outline is illustrated with a dashed line in FIGS. 2 and 3.

In the radiation element 110, the end 114 is an example of a first end, and the end 116 is an example of a second end. The line path from the end 114 to the end 116 through the branch point 112 is an example of a first line path. The section between the branch point 112 and the end 114 is an example of a first section of the first line path, and the section between the branch point 112 and the end 116 is an example of a second section of the first line path. The line path between the power feed point 111 and the branch point 112 is an example of a fourth line path.

The total length L1 of the line path between the power feed point 111 and the branch point 112, and the section between the branch point 112 and the end 114 is set to a quarter wavelength of the electrical length of the wavelength of the communication frequency f1. The communication frequency f1 is an example of a first communication frequency, and is a 2 GHz frequency band, for instance.

Also, the total length L2 of the line path between the power feed point 111 and the branch point 112, and the section between the branch point 112 and the end 116 is set to a quarter wavelength of the electrical length of the wavelength of the communication frequency f2. The communication frequency f2 is an example of a fourth communication frequency, and is an 800 MHz frequency band, for instance.

The radiation element 110 having the above configuration is a T-shaped antenna element that combines two monopole antennas capable of communicating in two frequency bands of a 2 GHz band and an 800 MHz band.

The sheet metal 120 is a rectangle-shaped metal plate in a plan view, having corners 121, 122, 123, and 124. The corner 121 is located on the positive X-axis direction side and the positive Y-axis direction side of the sheet metal 120, and the corners 121, 123, 124, and 122 are disposed in that order in a clockwise rotation. An end side 120A is between the corner 121 and the corner 122. The end side 120A is an example of a second end side.

As an example, the sheet metal 120 is provided to protect a display panel, such as a liquid crystal display (LCD) or an organic electro-luminescence (EL), of an electronic device including the wireless communication device 100, and extends over substantially the entire inside of the housing 30 in a plan view.

The sheet metal 120 is provided entirely on the negative Y-axis direction side of the ground plane 50, and is partially overlapped with the ground plane 50 in the Y-axis direction so that the end side 120A is located on the negative Y-axis direction side of the end side 50A. The sheet metal 120 is located on the negative Z-axis direction side of the ground plane 50, and is connected to the ground plane 50. For this reason, the sheet metal 120 is held at the same electric potential as that of the ground plane 50. The sheet metal 120 is held at the ground potential as an example.

The metal plate 130A is connected to the positive X-axis direction side of the sheet metal 120, and the metal plate 130B is connected to the negative X-axis direction side of the sheet metal 120. Also, the radiation element 140 is connected to the corner 121, and the radiation element 150 is connected to the corner 122 on the negative X-axis direction side and the positive Y-axis direction side of the sheet metal 120.

The metal plate 130A has a connection portion 131A and an end 132A, and extends in the Y-axis direction between the connection portion 131A and the end 132A. The metal plate 130A is connected to the sheet metal 120 at the end of the positive X-axis direction side of the sheet metal 120. The metal plate 130A is formed integrally with the sheet metal 120 as an example. The reason why the metal plate 130A and the sheet metal 120 are integrally formed is to reinforce the strength of the electronic device including the wireless communication device 100. It is to be noted that the metal plate 130A is an example of a first metal plate, and the connection portion 131A is an example of a third connection portion.

The metal plate 130A is exposed to a lateral surface of the housing 30. Here, the metal plate 130A is exposed to a lateral surface of the housing 30 indicates that the metal plate 130A is visible from the outside of the lateral surface of the housing 30, and a part of the lateral surface, along the XY plane, of the metal plate 130A may appear outside of the housing 30 as the housing 30 in which the outline is illustrated with a dashed line in FIGS. 2 and 3.

The connection portion 131A of the metal plate 130A is connected to the corner 121 of the sheet metal 120 as well as connected to a connection portion 141 of the radiation element 140 at the corner 121.

The metal plate 130B has a connection portion 131B and an end 132B, and extends in the Y-axis direction between the connection portion 131B and the end 132B. The metal plate 130B is connected to the sheet metal 120 at the end of the negative X-axis direction side of the sheet metal 120. The metal plate 130B is formed integrally with the sheet metal 120 as an example. The reason why the metal plate 130B and the sheet metal 120 are integrally formed is to reinforce the strength of the electronic device including the wireless communication device 100.

The metal plate 130B is an example of a second metal plate, and the connection portion 131B is an example of a fourth connection portion.

The metal plate 130B is exposed to a lateral surface of the housing 30. The metal plate 130B is exposed to a lateral surface of the housing 30 and the metal plate 130A is exposed to a lateral surface of the housing 30 have the same meaning.

The connection portion 131B of the metal plate 130B is connected to the corner 122 of the sheet metal 120 as well as connected to a connection portion 151 of the radiation element 150 at the corner 122.

The radiation element 140 has the connection portion 141, an end 142, a branch point 143, and an end 144. The radiation element 140 is coupled to the radiation element 110 and operates as a parasitic element, and also operates as a feed element with power fed via the later-described cutoff circuit. The radiation element 140 is an example of a second radiation element.

The connection portion 141 is connected to the corner 121 of the sheet metal 120 as well as connected to the connection portion 131A of the metal plate 130A. The radiation element 140 extends in the positive Y-axis direction from the connection portion 141 to the end 142.

The end 142 is provided in the vicinity of the end 114 of the radiation element 110. In other words, the end 142 is provided on the negative Y-axis direction side of the end 114 with a predetermined space from the end 114. The space between the end 142 of the radiation element 140 and the end 114 of the radiation element 110 in the Y-axis direction allows the radiation element 140 to be coupled to the radiation element 110 and to receive current supply from the radiation element 110. In this configuration, a slit is provided between the end 142 of the radiation element 140 and the end 114 of the radiation element 110.

The branch point 143 is located between the connection portion 141 and the end 142. The branch point 143 is connected to a line path which extends to the end 144 on the negative X-axis direction side (the inner side of the housing 30). The end 144 is connected to a power feed circuit via the later-described cutoff circuit.

The above radiation element 140 is formed integrally with the sheet metal 120 and the metal plate 130A as an example. Also, the section between the connection portion 141 and the end 142 is exposed from a lateral surface of the housing 30.

Here, the section between the connection portion 141 and the end 142 of the radiation element 140 is exposed to a lateral surface of the housing 30 indicates that the section between the connection portion 141 and the end 142 is visible from the outside of the lateral surface of the housing 30, and a part of the lateral surface, along the XY plane, of the section between the connection portion 141 and the end 142 may appear outside of the housing 30 as the housing 30 in which the outline is illustrated with a dashed line in FIGS. 2 and 3.

Since the radiation element 140 is formed integrally with the metal plate 130A, the section between the connection portion 141 and the end 142 is exposed from a lateral surface of the housing 30 continuously with the metal plate 130A.

In the radiation element 140, the connection portion 141 is an example of a first connection portion, the end 142 is an example of a third end, the branch point 143 is an example of a first point, and the end 144 is an example of a fourth end. Also, the line path between the connection portion 141 and the end 142 is an example of a second line path, and the line path between the branch point 143 and the end 144 is an example of a third line path.

Also, length L3 of the line path between the connection portion 141 and the end 142 is set to a quarter wavelength of the electrical length of the wavelength of the communication frequency f3. The communication frequency f3 is an example of a second communication frequency, and is a 1.5 GHz frequency band, for instance. The 1.5 GHz frequency band also includes 1.6 GHz frequency band. The line path between the connection portion 141 and the end 142 is coupled to the radiation element 110, and radiates as a monopole parasitic element.

Also, length L4 from the connection portion 141 to the end 144 through the branch point 143 is set to a quarter wavelength of the electrical length of the wavelength of the communication frequency f4. The communication frequency f4 is an example of a third communication frequency, and is a 2.4 GHz frequency band, for instance.

Also, length L5 from the end 142 to the end 144 through the branch point 143 is set to a quarter wavelength of the electrical length of the wavelength of the communication frequency f5. The communication frequency f5 is an example of a fifth communication frequency, and is a 5 GHz frequency band, for instance.

To the radiation element 140, 2.4 GHz power and 5 GHz power are fed from a power feed circuit via the later-described cutoff circuit, the section from the connection portion 141 to the end 144 through the branch point 143 performs communication at 2.4 GHz, and the section from the end 142 to the end 144 through the branch point 143 performs communication at 5 GHz. It is to be noted that 2.4 GHz and 5 GHz are frequencies in which communication is also performed by the radiation element 150 in the multi-input multi-output (MIMO) format.

The radiation element 150 has the connection portion 151, an end 152, a branch point 153, and an end 154. The radiation element 150 is coupled to the radiation element 110 and operates as a parasitic element, and also operates as a feed element with power fed via the later-described cutoff circuit. The radiation element 150 is an example of a third radiation element.

The connection portion 151 is connected to the corner 122 of the sheet metal 120 as well as connected to the connection portion 131B of the metal plate 130B. The radiation element 150 extends in the positive Y-axis direction from the connection portion 151 to the end 152.

The end 152 is provided in the vicinity of the end 116 of the radiation element 110. In other words, the end 152 is provided on the negative Y-axis direction side of the end 116 with a predetermined space from the end 116. The space between the end 152 of the radiation element 150 and the end 116 of the radiation element 110 in the Y-axis direction allows the radiation element 150 to be coupled to the radiation element 110 and to receive current supply from the radiation element 110. In this configuration, a slit is provided between the end 152 of the radiation element 150 and the end 116 of the radiation element 110.

The branch point 153 is located between the connection portion 151 and the end 152. The branch point 153 is connected to a line path which extends to the end 154 on the positive X-axis direction side (the inner side of the housing 30). The end 154 is connected to a power feed circuit via the later-described cutoff circuit.

The above radiation element 150 is formed integrally with the sheet metal 120 and the metal plate 130B as an example. Also, the section between the connection portion 151 and the end 152 is exposed from a lateral surface of the housing 30.

The section between the connection portion 151 and the end 152 of the radiation element 150 is exposed to a lateral surface of the housing 30 indicates a similar situation to that the section between the connection portion 141 and the end 142 of the radiation element 140 is exposed to a lateral surface of the housing 30 from the outside of the lateral surface of the housing 30.

Since the radiation element 150 is formed integrally with the metal plate 130B, the section between the connection portion 151 and the end 152 is exposed from a lateral surface of the housing 30 continuously with the metal plate 130B.

In the radiation element 150, the connection portion 151 is an example of a second connection portion, the end 152 is an example of a fifth end, the branch point 153 is an example of a third point, and the end 154 is an example of a sixth end. Also, the line path between the connection portion 151 and the end 152 is an example of a fifth line path, and the line path between the branch point 153 and the end 154 is an example of a sixth line path.

Also, length L6 between the connection portion 151 and the end 152 is set to a quarter wavelength of the electrical length of the wavelength of the communication frequency f6. The communication frequency f6 is an example of a sixth communication frequency, and is a 1.8 GHz frequency band, for instance. The line path between the connection portion 151 and the end 152 is coupled to the radiation element 110, and radiates as a monopole parasitic element. Although the physical length L6 of the line path between the connection portion 151 and the end 152 is equal to the physical length L3 of the line path between the connection portion 141 and the end 142 of the radiation element 140, the electrical lengths are made different by the later-described impedance component.

Also, length L7 from the connection portion 151 to the end 154 through the branch point 153 is set to a quarter wavelength of the electrical length of the wavelength of the communication frequency f7. The communication frequency f7 is an example of a seventh communication frequency, and is a 2.4 GHz frequency band, for instance.

Here, as an example, an embodiment will be described in which the length L7 from the connection portion 151 to the end 154 through the branch point 153 of the radiation element 150 is equal to the length L4 from the connection portion 141 to the end 144 through the branch point 143 of the radiation element 140, and the communication frequency f7 is equal to the communication frequency f4. However, when the electrical lengths in these sections are made different, it is possible to make the communication frequency f7 and the communication frequency f4 different from each other.

Also, length L8 from the end 152 to the end 154 through the branch point 153 is set to a quarter wavelength of the electrical length of the wavelength of the communication frequency f8. The communication frequency f8 is an example of an eighth communication frequency, and is a 5 GHz frequency band, for instance.

Here, as an example, an embodiment will be described in which the length L8 from the end 152 to the end 154 through the branch point 153 of the radiation element 150 is equal to the length L5 from the end 142 to the end 144 through the branch point 143 of the radiation element 140, and the communication frequency f8 is equal to the communication frequency f5. However, when the electrical lengths in these sections are made different, it is possible to make the communication frequency f8 and the communication frequency f5 different from each other.

In the radiation element 150, 2.4 GHz power and 5 GHz power are fed from a power feed circuit via the later-described cutoff circuit, the section from the connection portion 151 to the end 154 through the branch point 153 performs communication at 2.4 GHz, and the section from the end 152 to the end 154 through the branch point 153 performs communication at 5 GHz.

2.4 GHz and 5 GHz are frequencies in which communication is also performed by the radiation elements 140 and 150 in the MIMO format. Thus, the radiation elements 140 and 150 may be regarded as MIMO antennas.

Figure 5:
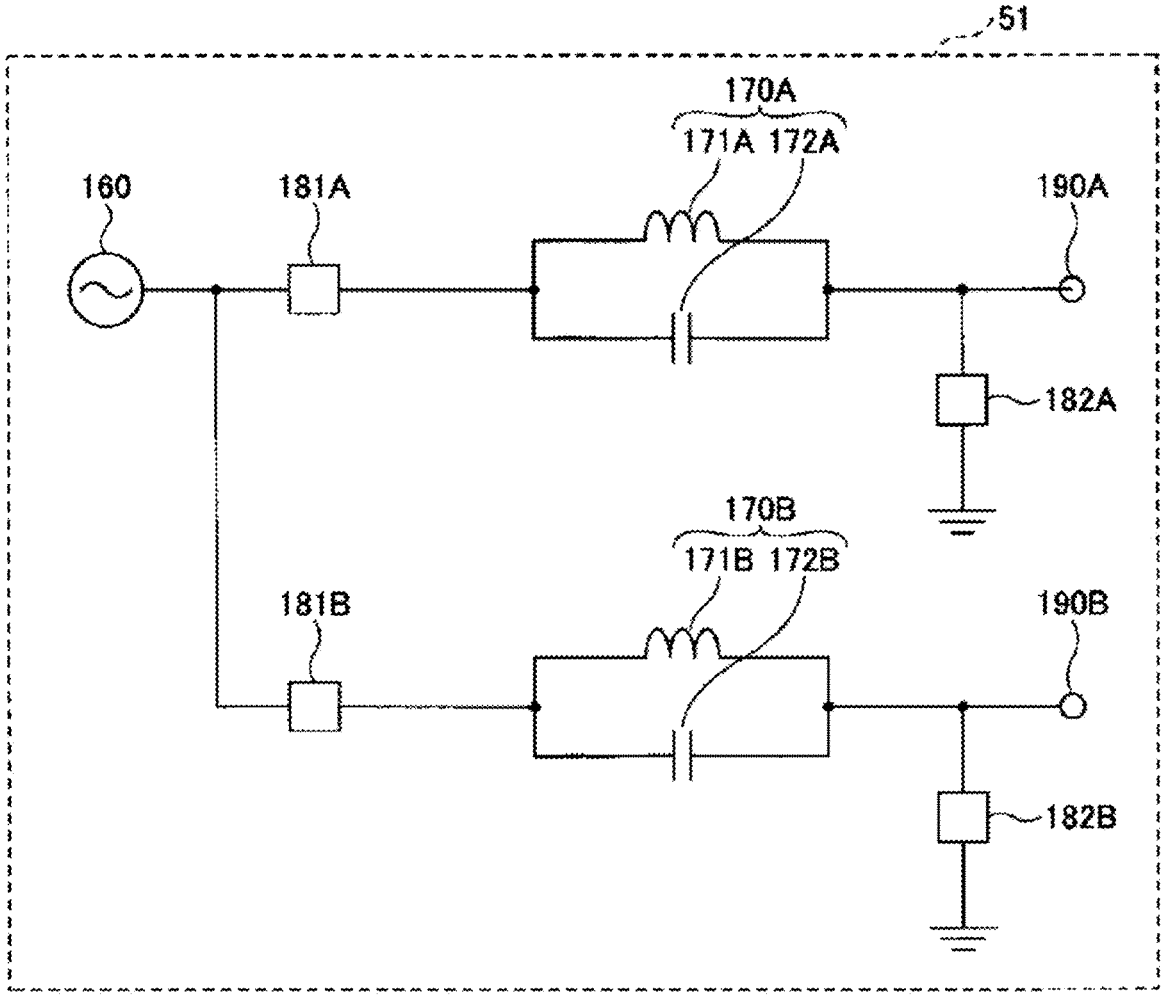
FIG. 5 is diagram illustrating a circuit including a power feed circuit and cutoff circuits.

FIG. 5 is diagram illustrating a circuit including the power feed circuit 160 and cutoff circuits 170A, 170B. The power feed circuit 160 is connected to the cutoff circuits 170A, 170B via impedance components 181A, 181B, and terminals 190A, 190B are connected to the opposite side of the cutoff circuits 170A, 170B. The terminals 190A and 190B are connected to the end 144 of the radiation element 140 and the end 154 of the radiation element 150, respectively.

In other words, the impedance component 181A, the cutoff circuit 170A, and the terminal 190A, and the impedance component 181B, the cutoff circuit 170B, and the terminal 190B are connected to the power feed circuit 160 in parallel.

Also, an impedance component 182A is provided in a line path branched to the ground point from a point between the cutoff circuit 170A and the terminal 190A, and an impedance component 182B is provided in a line path branched to the ground point from a point between the cutoff circuit 170B and the terminal 190B.

It is to be noted that the power feed circuit 160, the cutoff circuits 170A, 170B, the impedance components 181A, 181B, 182A, and 182B, and the terminals 190A, 190B are mounted on the wiring board 51.

The power feed circuit 160 is a radiofrequency source that outputs power in a 2.4 GHz frequency band and a 5 GHz frequency band. The radiofrequency source is, for instance, a device modularizing a radiofrequency source chip that outputs power in a 2.4 GHz frequency band and a radiofrequency source chip that outputs power in a 5 GHz frequency band. The power feed circuit 160 outputs power in frequency bands (2.4 GHz and 5 GHz) to both the radiation elements 140 and 150. The power feed circuit 160 is an example of a first power feed circuit and a second power feed circuit.

It is to be noted that the power feed circuit 160 may be divided into two power feed circuits so as to feed power to the radiation elements 140 and 150 separately. Also, the power feed circuit 160 may be divided into a power feed circuit that feeds power in a 2.4 GHz frequency band, and a power feed circuit that feeds power in a 5 GHz frequency band to the radiation elements 140 and 150. Furthermore, the power feed circuit 160 may be divided into four power feed circuits so as to feed power in 2.4 GHz and 5 GHz frequency bands to the radiation elements 140 and 150.

The cutoff circuit 170A has a coil 171A and a capacitor 172A connected in parallel, and has an impedance characteristic that cuts off the frequency band of the communication frequency f3 (1.5 GHz). The cutoff circuit 170A is an example of a first cutoff circuit.

The cutoff circuit 170A is a circuit that cuts off the resonance current of the communication frequency f3 (1.5 GHz) to avoid flow of the resonance current into the power feed circuit 160, the resonance current occurring in the line path which is between the connection portion 141 and the end 142 of the radiation element 140 and serves as a parasitic element.

The cutoff circuit 170B has a coil 171B and a capacitor 172B connected in parallel, and has an impedance characteristic that cuts off the frequency band of the communication frequency f6 (1.8 GHz). The cutoff circuit 170B is an example of a second cutoff circuit.

The cutoff circuit 170*b* is a circuit that cuts off the resonance current of the communication frequency f6 (1.8 GHz) to avoid flow of the resonance current into the power feed circuit 160, the resonance current occurring in the line path which is between the connection portion 151 and the end 152 of the radiation element 150 and serves as a parasitic element.

The impedance components 181A, 182A is implemented by a coil chip and a capacitor chip, or a chip including a coil and a capacitor, and is provided to adjust the impedance between the power feed circuit 160 and the terminal 190A as well as to achieve resonance of the communication frequency f3 (1.5 GHz) by the line path between the connection portion 141 and the end 142 of the radiation element 140. The impedance of the impedance components 181A, 182A is adjusted so that the length L3 of the line path between the connection portion 141 and the end 142 is equal to a quarter wavelength of the electrical length of the wavelength at 1.5 GHz.

The impedance components 181B, 182B is implemented by a coil chip and a capacitor chip, or a chip including a coil and a capacitor, and is provided to adjust the impedance between the power feed circuit 160 and the terminal 190B as well as to achieve resonance of the communication frequency f6 (1.8 GHz) by the line path between the connection portion 151 and the end 152 of the radiation element 150. The impedance of the impedance components 181B, 182B is adjusted so that the length L6 of the line path between the connection portion 151 and the end 152 is equal to a quarter wavelength of the electrical length of the wavelength at 1.8 GHz.

Figure 6A:
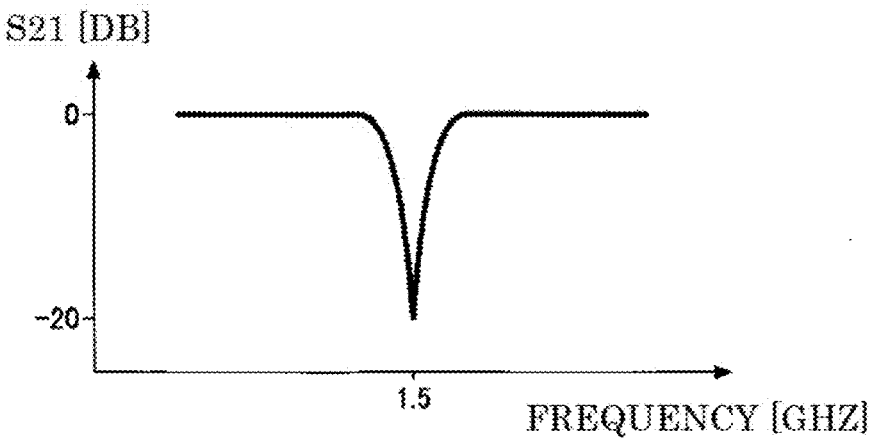
FIGS. 6A, 6B are graphs illustrating frequency characteristics of S21 parameter of cutoff circuits.

FIG. 6 is a graph illustrating the frequency characteristics of S21 parameter of the cutoff circuits 170A, 170B. As illustrated in FIG. 6A, the cutoff circuit 170A has characteristics that the value of S21 parameter is sharply reduced at 1.5 GHz frequency band by setting the inductance of the coil 171A and the electrostatic capacitance of the capacitor 172A. Giving such impedance characteristics to the cutoff circuit 170A allows a resonance current of the communication frequency f3 (1.5 GHz) inputted from the terminal 190A to be cut off, and flow of the resonance current into the power feed circuit 160 to be protected.

Figure 6B:
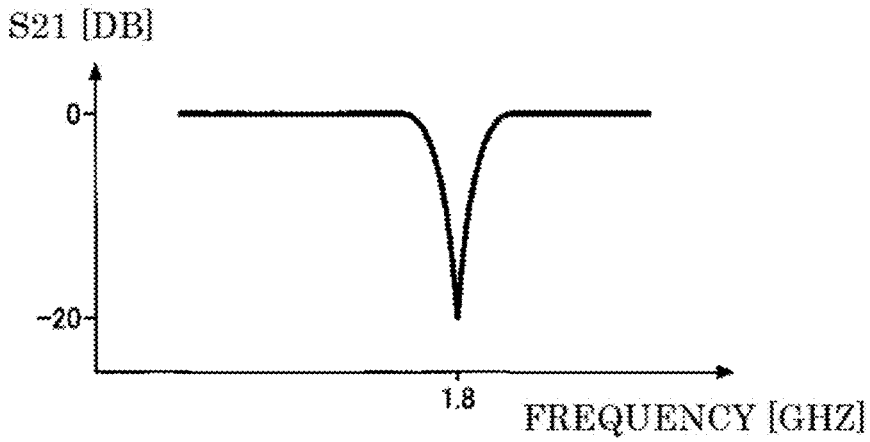

Also, as illustrated in FIG. 6B, the cutoff circuit 170B has characteristics that the value of S21 parameter is sharply reduced at 1.8 GHz frequency band by setting the inductance of the coil 171B and the electrostatic capacitance of the capacitor 172B. Giving such impedance characteristics to the cutoff circuit 170B allows a resonance current of the communication frequency f6 (1.8 GHz) inputted from the terminal 190B to be cut off, and flow of the resonance current into the power feed circuit 160 to be protected.

FIG. 7A to 7E and FIG. 8A to 8D illustrate simulation results of current distribution of the wireless communication device 100. In FIG. 7A to 7E and FIG. 8A to 8D, a current distribution is illustrated by gray scale: a portion having a high current value is densely illustrated and a portion having a low current value is lightly illustrated. It is to be noted that in FIG. 7A to 7E and FIG. 8A to 8D, the outline of the wireless communication device 100 corresponding to FIG. 2 is illustrated, and symbols are omitted.

Figure 7A:
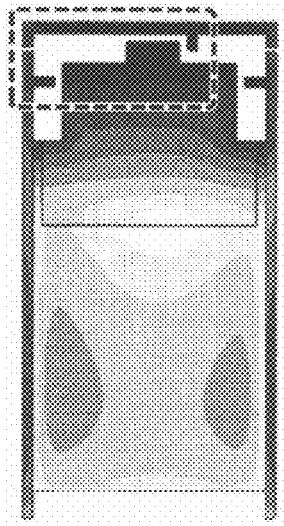
FIGS. 7A-7E illustrate simulation results of a current distribution of the wireless communication device.

FIG. 7A illustrates a current distribution when 800 MHz (communication frequency f2) power is fed to the power feed point 111. In order for the section including the power feed point 111, the branch point 112, the bent portion 115, and the end 116 of the radiation element 110 to perform communication at 800 MHz, as illustrated by a dashed line, the current value is higher on the left side of the power feed point 111 in the radiation element 110.

Figure 7B:
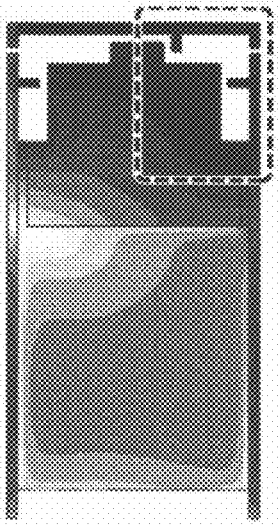

FIG. 7B illustrates a current distribution when 1.5 GHz (communication frequency f3) power is radiated. In order for the line path between the connection portion 141 and the end 142 of the radiation element 140 to perform communication at 1.5 GHz by being coupled to the radiation element 110 and fed with power, as illustrated by a dashed line, the line path between the connection portion 141 and the end 142 of the radiation element 140, the right side of the power feed point 111 in the radiation element 110, and the end side 50A of the ground plane 50 have a higher current value so as to forma loop.

Figure 7C:
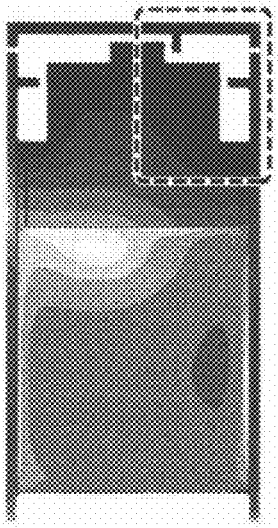

FIG. 7C illustrates a current distribution when 1.6 GHz power included in a 1.5 GHz frequency band of the communication frequency f3 is radiated. In order for the line path between the connection portion 141 and the end 142 of the radiation element 140 to perform communication at 1.6 GHz by being coupled to the radiation element 110 and fed with power, as illustrated by a dashed line, the line path between the connection portion 141 and the end 142 of the radiation element 140, the right side of the power feed point 111 in the radiation element 110, and the end side 50A of the ground plane 50 have a higher current value so as to form a loop. It is seen that the current distribution in FIG. 7C is slightly different from the current distribution illustrated in FIG. 7B.

Figure 7D:
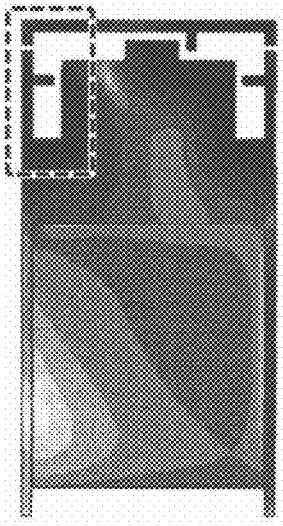

FIG. 7D illustrates a current distribution when 1.8 GHz (communication frequency f6) power is radiated. In order for the line path between the connection portion 151 and the end 152 of the radiation element 150 to perform communication at 1.8 GHz by being coupled to the radiation element 110 and fed with power, as illustrated by a dashed line, the line path between the connection portion 151 and the end 152 of the radiation element 150 has a higher current value.

Figure 7E:
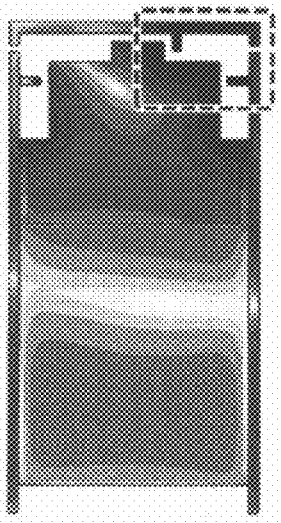

FIG. 7E illustrates a current distribution when 2 GHz (communication frequency f1) power is fed to the power feed point 111. In order for the section including the power feed point 111, the branch point 112, the bent portion 113, and the end 114 of the radiation element 110 to perform communication at 2 GHz, as illustrated by a dashed line, the current value is higher on the right side of the power feed point 111 in the radiation element 110.

Figure 8A:
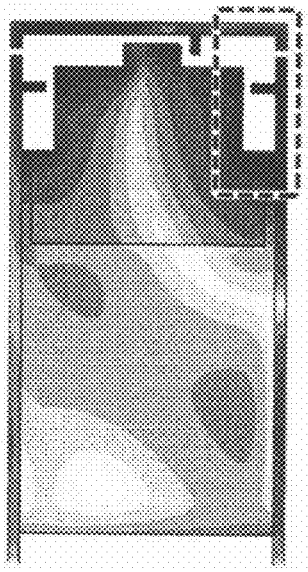
FIGS. 8A-8D illustrate simulation results of a current distribution of the wireless communication device.

FIG. 8A illustrates a current distribution when 2.4 GHz (communication frequency f4) power is fed from the power feed circuit 160 to the end 144 of the radiation element 140 via the cutoff circuit 170. In order for the section including the end 144, the branch point 143, and the connection portion 141 of the radiation element 140 to perform communication at 2.4 GHz, as illustrated by a dashed line, the current value is higher mainly on the lower side of the branch point 143 in the radiation element 140, and along the end side of the ground plane 50.

Figure 8B:
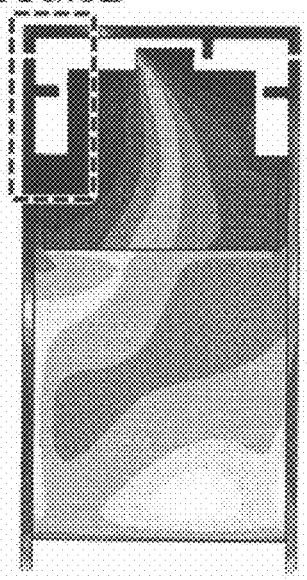

FIG. 8B illustrates a current distribution when 2.4 GHz (communication frequency f7) power is fed from the power feed circuit 160 to the end 154 of the radiation element 150 via the cutoff circuit 170. In order for the section including the end 154, the branch point 153, and the connection portion 151 of the radiation element 150 to perform communication at 2.4 GHz, as illustrated by a dashed line, the current value is higher mainly on the lower side of the branch point 153 in the radiation element 150, and along the end side of the ground plane 50.

Figure 8C:
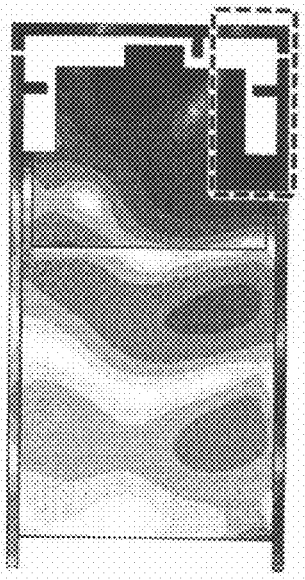

FIG. 8C illustrates a current distribution when 5 GHz (communication frequency f5) power is fed from the power feed circuit 160 to the end 144 of the radiation element 140 via the cutoff circuit 170. In order for the section including the end 144, the branch point 143, and the end 142 of the radiation element 140 to perform communication at 5 GHz, as illustrated by a dashed line, the current value is higher mainly on the upper side of the branch point 143 in the radiation element 140, and along the end side of the ground plane 50.

Figure 8D:
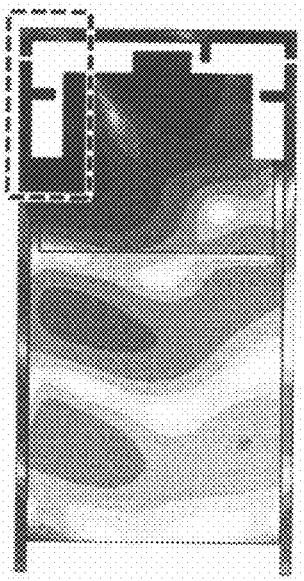

FIG. 8D illustrates a current distribution when 5 GHz (communication frequency f8) power is fed from the power feed circuit 160 to the end 154 of the radiation element 150 via the cutoff circuit 170. In order for the section including the end 154, the branch point 153, and the end 152 of the radiation element 150 to perform communication at 5 GHz, as illustrated by a dashed line, the current value is higher mainly on the upper side of the branch point 153 in the radiation element 150, and along the end side of the ground plane 50.

As described above, it has been verified that it is possible to perform the following eight types of communication in six frequency bands: 2 GHz (communication frequency f1) of the radiation element 110, 800 MHz (communication frequency f2) of the radiation element 110, 1.5 GHz (communication frequency f3) of the radiation element 140, 2.4 GHz (communication frequency f4) of the radiation element 140, 5 GHz (communication frequency f5) of the radiation element 140, 1.8 GHz (communication frequency f6) of the radiation element 150, 2.4 GHz (communication frequency f7) of the radiation element 150, and 5 GHz (communication frequency f8) of the radiation element 150.

Among these, the communication frequencies f3, f4, f5, f6, f7, and f8 are achieved by the radiation elements 140 and 150 of the wireless communication device 100, which serve as a parasitic element as well as a feed element. Also, here, the embodiment has been described in which the radiation elements 140 and 150 both perform communication at 2.4 GHz and 5 GHz as the MIMO antennas.

However, when the length between the connection portion 141 and the branch point 143 of the radiation element 140, the length between the end 142 and the branch point 143 of the radiation element 140, the length between the connection portion 151 and the branch point 153 of the radiation element 150, and the length between the end 152 and the branch point 153 of the radiation element 150 are made different, a MIMO antenna is no longer achieved. In this case, it is possible to perform communication in totally eight frequency bands.

The multiple conductive members of the conventional mobile terminal are a first radiation member fed with power by a first power feed unit and a second radiation member fed with power by a second power feed unit, but the first radiation member and the second radiation member are each a radiation member having one frequency band for communication. In short, the first radiation member and the second radiation member are each a radiation member corresponding to one frequency band.

Thus, it is aimed to provide a wireless communication device capable of communicating in more frequency bands.

According to the embodiment above, the radiation elements 140 and 150 of the wireless communication device 100 both serve as a parasitic element and a feed element, thereby making it possible to increase the number of frequency bands which allow communication without increasing the number of radiation elements, as compared with the case where instead of the radiation elements 140 and 150, the wireless communication device 100 includes two radiation elements, each of which serves as one of a parasitic element and a feed element.

Therefore, it is possible to provide the wireless communication device 100 capable of performing communication in more frequency bands.

Also, the radiation elements 140 and 150 both serve as a parasitic element and a feed element, thereby making it possible to perform communication in more frequency bands without increasing the number of radiation elements and ensuring a space for installing an additional radiation element.

Although the embodiment has been described in which the wireless communication device 100 includes the radiation element 150, the wireless communication device 100 may not include the radiation element 150. In this case, communication is possible in five frequency bands with the communication frequencies f1, f2, f3, f4, and f5. The communication frequencies f3, f4, and f5 are achieved by the radiation element 140 that serves as a parasitic element and a feed element.

Also in this case, it is possible to increase the number of frequency bands which allow communication without increasing the number of radiation elements, as compared with the case where instead of the radiation element 140, the wireless communication device 100 includes one radiation element which serves as a parasitic element or a feed element.

The embodiment has been described above, in which in addition to performing communication as a parasitic element in the communication frequency f3 (1.5 GHz), the radiation element 140 performs communication in the communication frequency f4 (2.4 GHz) and the communication frequency f5 (5 GHz) by being fed with power in the two frequency bands. However, in addition to performing communication as a parasitic element in the communication frequency f3 (1.5 GHz), the radiation element 140 may perform communication by being fed with power in a frequency band having one of the communication frequency f4 (2.4 GHz) and the communication frequency f5 (5 GHz). For instance, increasing the length between the connection portion 141 and the branch point 143 or the length between the end 142 and the branch point 143 enables the radiation element 140 to perform communication by being fed with power in one of the communication frequency f4 (2.4 GHz) and the communication frequency f5 (5 GHz).

Similarly, increasing the length between the connection portion 151 and the branch point 153 or the length between the end 152 and the branch point 153 enables the radiation element 150 to perform communication by being fed with power in one of the communication frequency f4 (2.4 GHz) and the communication frequency f5 (5 GHz).

Although the embodiment has been described above, in which the radiation element 110 is a T-shaped antenna element which combines two monopole antennas, the radiation element 110 may be a monopole antenna that performs communication in one frequency band. In this case, it is sufficient that the end 114 becomes an open end of the monopole antenna to be coupled to the radiation element 140 and fed with power. Also, the wireless communication device 100 may not include the radiation element 150.

Also, in case that the sheet metal 120 is desirably further increased in size and the end side 120A is desirably moved in the positive Y-axis direction, the wireless communication device 100 may be modified as follows.

Figure 9:
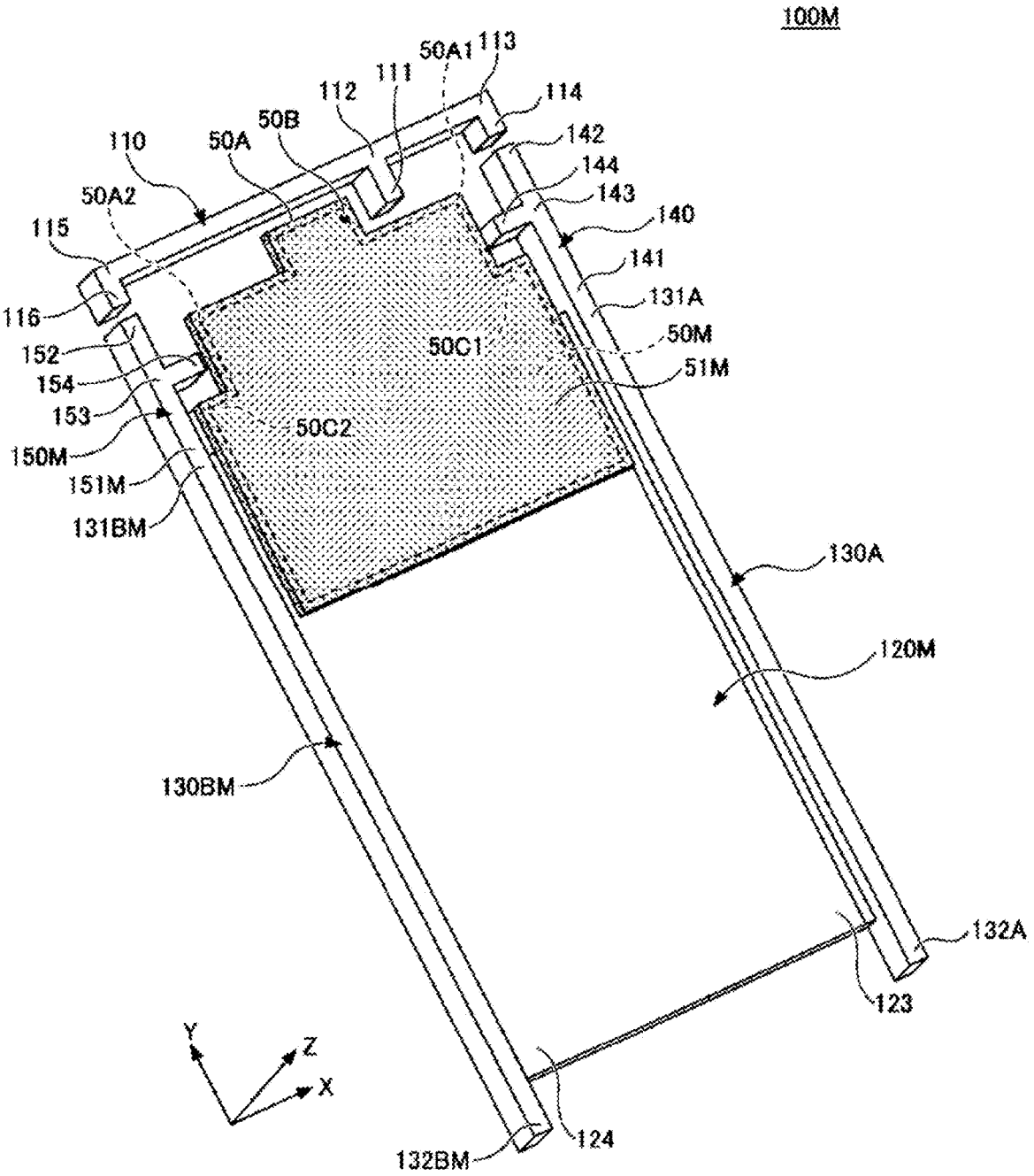
FIG. 9 illustrates a wireless communication device in a modification of the embodiment.
Figure 10:
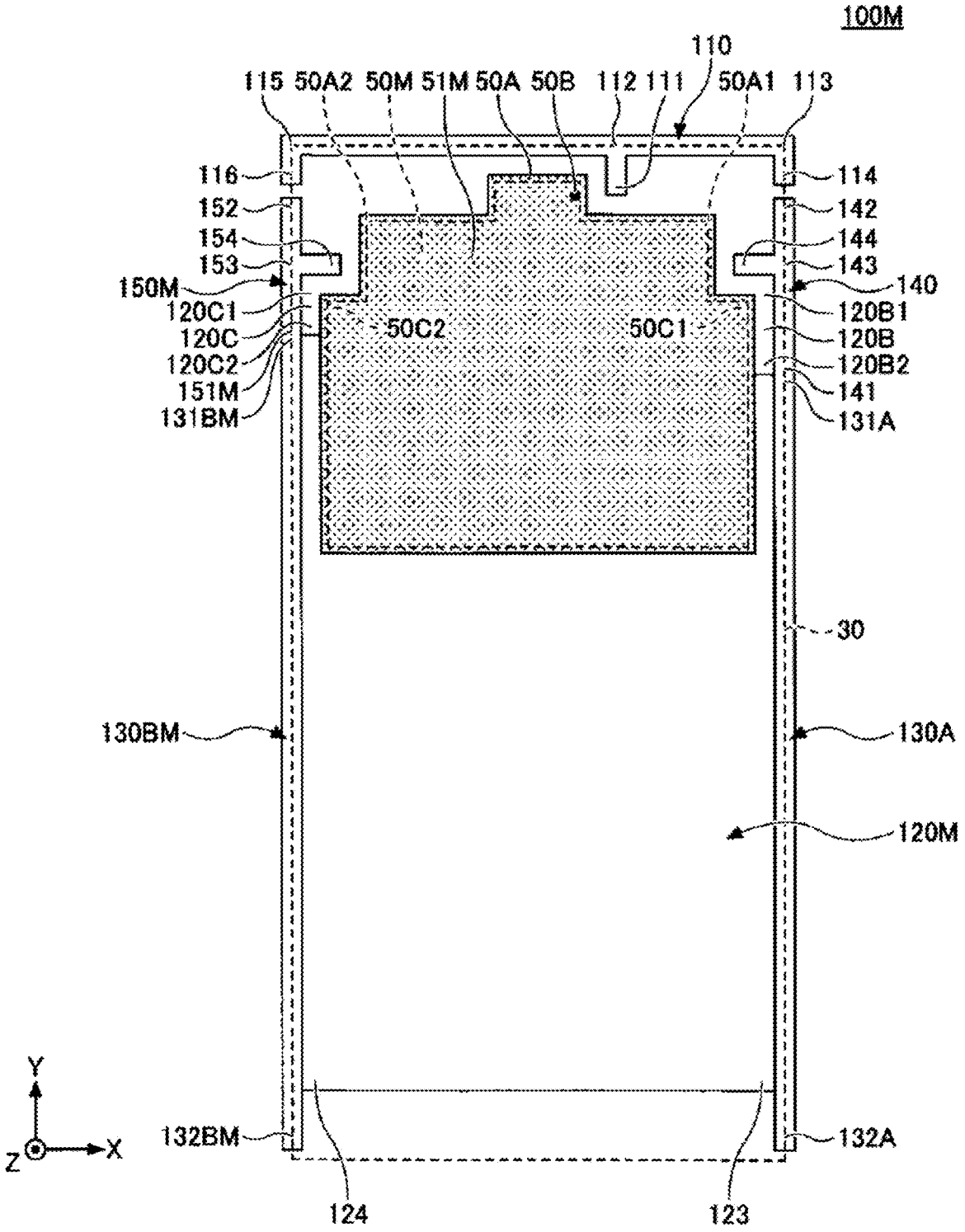
FIG. 10 illustrates a wireless communication device in a modification of the embodiment.
Figure 11:
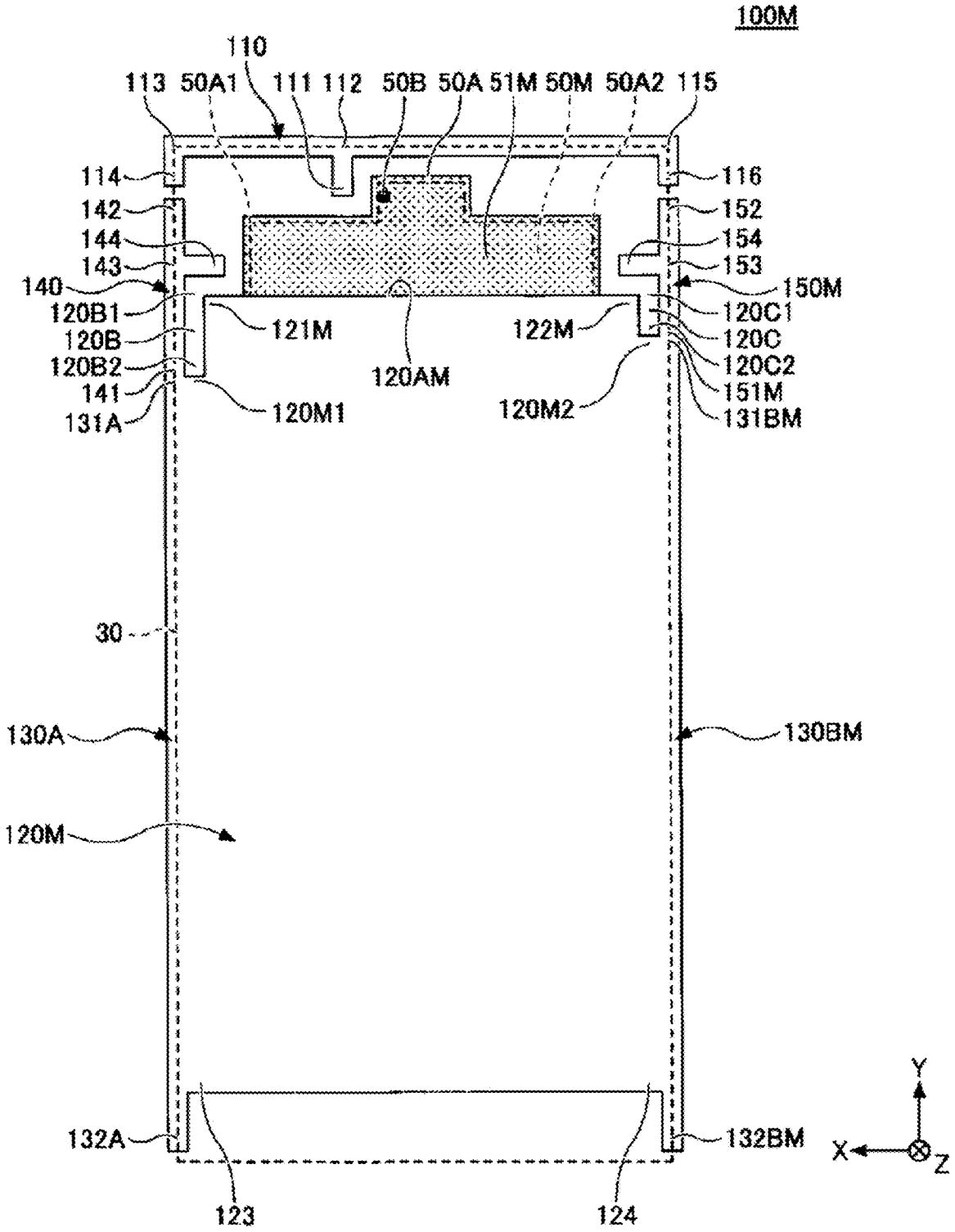
FIG. 11 illustrates a wireless communication device in a modification of the embodiment.

FIGS. 9 to 11 illustrate a wireless communication device 100M in a modification of the embodiment. Hereinafter a description is given with the XYZ coordinate system defined. FIG. 9 is a perspective view, FIG. 10 is a view illustrating the positive Z-axis direction side, and FIG. 11 is a view illustrating the negative Z-axis direction side. Also, hereinafter XY plan view is referred to as a plan view.

Figure 12:
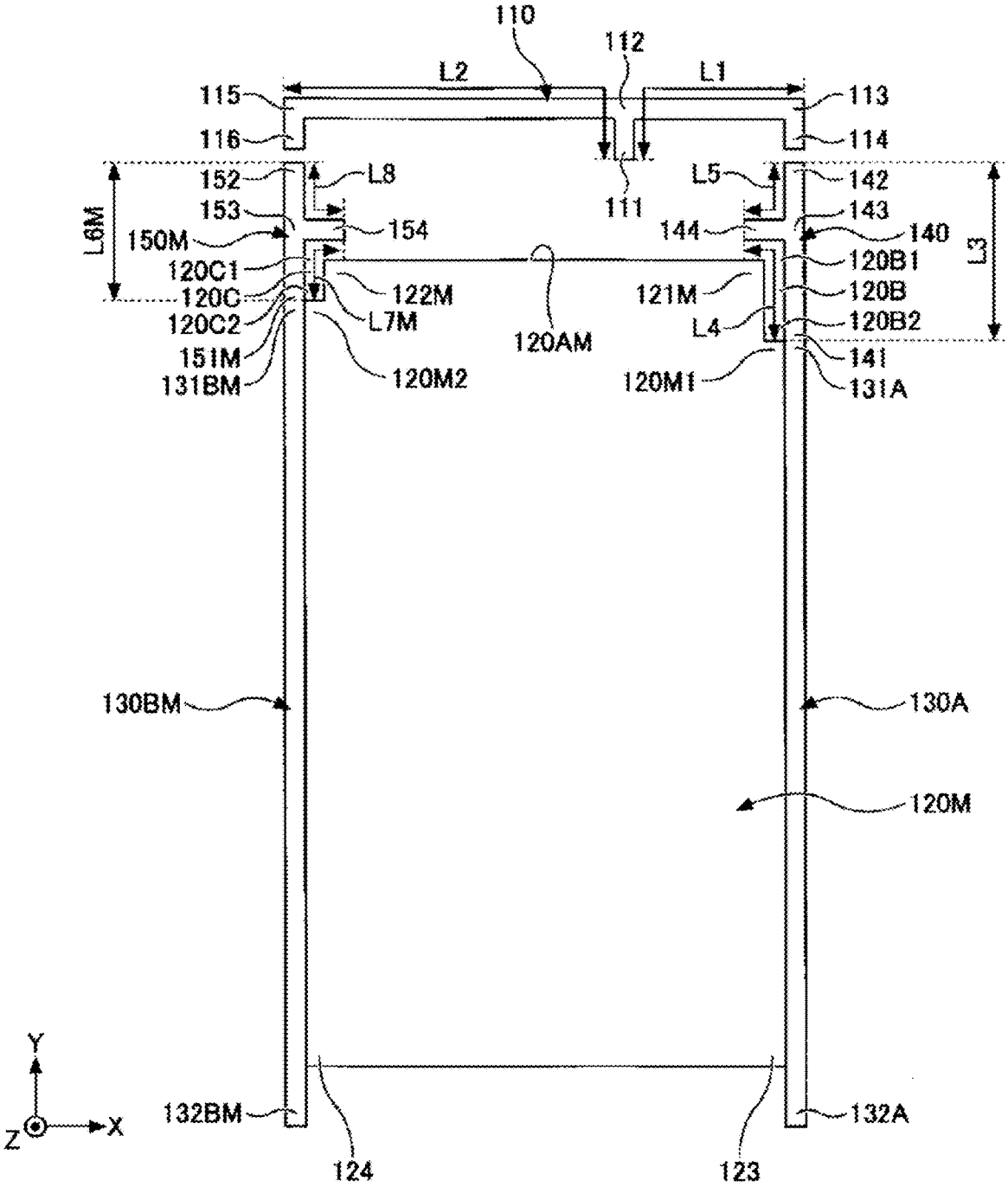
FIG. 12 is a view illustrating the state where the housing and the ground plane are removed from FIG. 10.

The wireless communication device 100M includes a housing 30, a ground plane 50M, a radiation element 110, a sheet metal 120M, metal plates 130A, 130BM, a radiation element 140, and a radiation element 150M. Among these components, for the housing 30, illustration is omitted in FIG. 9, and the outline is illustrated in FIGS. 10 and 11. Hereinafter a description is given with reference to FIG. 12 in addition to FIGS. 9 to 11. FIG. 12 is a view illustrating the state where the housing 30 and the ground plane 50M are removed from FIG. 10.

Hereinafter an embodiment in which the wireless communication device 100M performs communication in eight communication frequencies f1 to f8 will be described. The communication frequencies f1 to f8 each indicate a frequency band including a resonance frequency, and are same as the communication frequencies f1 to f8 of the wireless communication device 100 described with reference to FIGS. 1 to 4.

The wireless communication device 100M differs from the wireless communication device 100 described with reference to FIGS. 1 to 4 in that an end side 120AM of a sheet metal 120M is located on the positive Y-axis direction side of the end side 120A illustrated in FIGS. 2 to 4, and slits 120B, 120C are provided on both sides of the end side 120AM.

Due to inclusion of such sheet metal 120M, the configuration of the ground plane 50M, the metal plate 130BM, and the radiation element 150M of the wireless communication device 100M differs from the ground plane 50, the metal plate 130B, and the radiation element 150 of the wireless communication device 100 described with reference to FIGS. 1 to 4. Since other components are the same as those of the wireless communication device 100 described with reference to FIGS. 1 to 4, the same components are labeled with the same symbol, and a description thereof is omitted.

The wireless communication device 100M is a device that is included in an electronic device, such as a smartphone terminal, a mobile phone terminal, a tablet computer, and a game machine, and that performs data communication with multiple frequency bands. Here, a description is given under the assumption that the wireless communication device 100M includes the housing 30. However, the wireless communication device 100M not including the housing 30 may be applicable.

The ground plane 50M is provided at an end on the positive Y-axis direction side within the housing 30, and extends along the XY plane. The ground plane 50M is a metal layer disposed in the front surface, the back surface, or an inner layer of a wiring board 51M in conformity with, for instance, the FR-4 standard. The ground plane 50M is held at a reference potential. The reference potential is the ground potential as an example. The ground plane 50M may be treated as a ground plate or an earth plate.

The ground plane 50M is different in shape from the ground plane 50 illustrated in FIGS. 1 to 3 because the end side 120AM of the sheet metal 120M is located on the positive Y-axis direction side of the end side 120A illustrated in FIGS. 2 to 4, and the slits 120B, 120C are provided. The ground plane 50M includes extending portions 50C1 and 50C2 located near the slits 120B and 120C in a plan view. The extending portions 50C1, 50C2 extend to avoid the slits 120B, 120C in a plan view.

Also, the shape of the wiring board 51M is made different from that of the wiring board 51 illustrated in FIGS. 1 to 3 in conformity to the extending portions 50C1, 50C2 of the ground plane 50M.

The sheet metal 120M is a rectangle-shaped metal plate in a plan view, having corners 121M, 122M, 123M, and 124M. The corners 121M, 122M are located at both ends of the end side 120AM. Thus, the corners 121M, 122M are located on the positive Y-axis direction side of the corners 121, 122 illustrated in FIGS. 3 and 4.

As an example, such sheet metal 120M is provided to protect a display panel, such as an LCD or an organic EL, of an electronic device including the wireless communication device 100M, and extends over substantially the entire inside of the housing 30 in a plan view. Also, the sheet metal 120M is connected to the ground plane 50M, and held at the same electric potential as that of the ground plane 50M. The sheet metal 120M is held at the ground potential as an example.

The slit 120B is cut from an open end 120B1 located on the positive X-axis direction side of the corner 121M to an end 120B2 in the negative Y-axis direction along the metal plate 130A. The slit 120B is an example of a first cut-out portion, the open end 120B1 is an example of a first open end, and the end 120B2 is an example of a seventh end. The portion, on the negative Y-axis direction side, of the end 120B2 of the sheet metal 120M is a terminal end 120M1 at which the slit 120B terminates.

Also, the slit 120C is cut from an open end 120C1 located on the negative X-axis direction side of the corner 122M to an end 120C2 in the negative Y-axis direction along the metal plate 130B. The length of the slit 120C from the open end 120C1 to the end 120C2 is shorter than the length of the slit 120B from the open end 120B1 to the end 120B2. In other words, the end 120C2 is located on the positive Y-axis direction side of the end 120B2.

The slit 120C is an example of a second cut-out portion, the open end 120C1 is an example of a second open end, and the end 120C2 is an example of an eighth end. The portion, on the negative Y-axis direction side, of the end 120C2 of the sheet metal 120M is a terminal end 120M2 at which the slit 120C terminates.

The metal plate 130A is connected to the positive X-axis direction side of the sheet metal 120M, and the metal plate 130BM is connected to the negative X-axis direction side of the sheet metal 120M. Also, the radiation element 140 is connected to the terminal end 120M1, and the radiation element 150M is connected to the terminal end 120M2.

The connection portion 131A of the metal plate 130A is connected to the terminal end 120M1 of the sheet metal 120M as well as connected to the connection portion 141 of the radiation element 140 in the terminal end 120M1.

Similarly, a connection portion 131BM of the metal plate 130BM is connected to the terminal end 120M2 of the sheet metal 120M as well as connected to a connection portion 151M of the radiation element 150M in the terminal end 120M2. The connection portion 131BM is located on the positive Y-axis direction side of the connection portion 131B illustrated in FIGS. 1 to 4.

Also, the connection portion 141 of the radiation element 140 is connected to the terminal end 120M1 of the sheet metal 120M as well as connected to the connection portion 131A of the metal plate 130A. As an example, the radiation element 140 is formed integrally with the sheet metal 120M and the metal plate 130A.

The cutoff circuit 170A, the impedance components 181A, 182A, and the power feed circuit 160 are connected to the end 144 of the radiation element 140 via the terminal 190A illustrated in FIG. 5A.

The radiation element 150M has the connection portion 151M, the end 152, the branch point 153, and the end 154. The radiation element 150M is coupled to the radiation element 110 to operate as a parasitic element as well as is fed with power to operate as a feed element. The radiation element 150M is an example of a third radiation element.

The connection portion 151M is connected to the terminal end 120M2 of the sheet metal 120M as well as connected to the connection portion 131BM of the metal plate 130BM. The radiation element 150M extends in the positive Y-axis direction from the connection portion 151M to the end 152. The connection portion 151M is located on the positive Y-axis direction side of the connection portion 151 illustrated in FIGS. 1 to 4.

The radiation element 150M like this is formed integrally with the sheet metal 120M and the metal plate 130BM as an example. Also, the section between the connection portion 151M and the end 152 is exposed to a lateral surface of the housing 30.

Since the radiation element 150M is formed integrally with the metal plate 130BM, the section between the connection portion 151M and the end 152 is exposed from a lateral surface of the housing 30 continuously with the metal plate 130BM.

In the radiation element 150M, the connection portion 151M is an example of a second connection portion, and the line path between the connection portion 151M and the end 152 is an example of a fifth line path.

Also, length L6M of the line path between the connection portion 151M and the end 152 is set to a quarter wavelength of the electrical length of the wavelength of the communication frequency f6. Although the length L6M is physically shorter than the length L6 illustrated in FIG. 4, the length L6M is set to the same length as the electrical length, and is set to a quarter wavelength of the electrical length in 1.8 GHz as the communication frequency f6.

The line path between the connection portion 151M and the end 152 is coupled to the radiation element 110, and radiates as a monopole parasitic element.

Also, length L7M from the connection portion 151M to the end 154 through the branch point 153 is set to a quarter wavelength of the electrical length of the wavelength of the communication frequency f7. The communication frequency f7 is an example of a seventh communication frequency, and is a 2.4 GHz frequency band, for instance.

The length L7M is physically shorter than the length L4 from the connection portion 141 to the end 144 through the branch point 143 of the radiation element 140.

In the radiation element 150M, 2.4 GHz power and 5 GHz power are fed to the end 154, the section from the connection portion 151M to the end 154 through the branch point 153 performs communication at 2.4 GHz, and the section from the end 152 to the end 154 through the branch point 153 performs communication at 5 GHz.

The cutoff circuit 170B, the impedance components 181B, 182B, and the power feed circuit 160 are connected to the end 154 of the radiation element 150M via the terminal 190B illustrated in FIG. 5B. In the radiation element 150M, the line path from the connection portion 151M to the end 152 performs communication in a 1.5 GHz frequency band, and the line path from the connection portion 151 to the end 154 performs communication in a 2.4 GHz frequency band. But the length from the connection portion 151M to the branch point 153 is shorter than the length from the connection portion 151 to the branch point 153 illustrated in FIGS. 1 to 4.

Even with such a difference in the physical length, to achieve communication in the same frequency band as that of the radiation element 150 illustrated in FIGS. 1 to 4, the impedance of the impedance components 181B, 182B may be adjusted.

FIG. 13A to 13E and FIG. 14A to 14D each illustrate simulation results of current distribution of the wireless communication device 100M. In FIG. 13A to 13E and FIG. 14A to 14D, similarly to FIG. 7A to 7E and FIG. 8A to 8D, a current distribution is illustrated by gray scale. In FIG. 13A to 13E and FIG. 14A to 14D, the outline of the wireless communication device 100M corresponding to FIG. 10 is illustrated, and symbols are omitted.

Figure 13A:
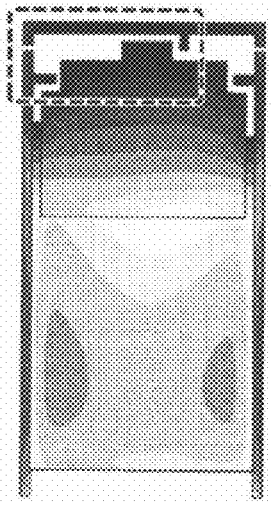
FIGS. 13A-13E illustrate simulation results of a current distribution of the wireless communication device.

FIG. 13A illustrates a current distribution when 800 MHz (communication frequency f2) power is fed to the power feed point 111. In order for the section including the power feed point 111, the branch point 112, the bent portion 115, and the end 116 of the radiation element 110 to perform communication at 800 MHz, as illustrated by a dashed line, the current value is higher on the left side of the power feed point 111 in the radiation element 110.

Figure 13B:
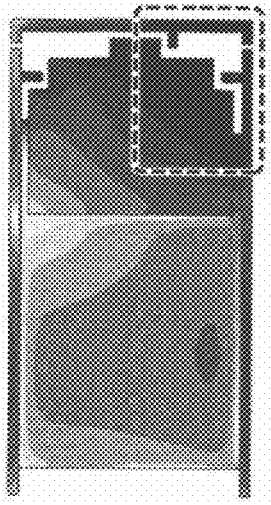

FIG. 13B illustrates a current distribution when 1.5 GHz (communication frequency f3) power is radiated. In order for the line path between the connection portion 141 and the end 142 of the radiation element 140 to perform communication at 1.5 GHz by being coupled to the radiation element 110 and fed with power, as illustrated by a dashed line, the line path between the connection portion 141 and the end 142 of the radiation element 140, the right side of the power feed point 111 in the radiation element 110, and the end side 50A of the ground plane 50M have a higher current value so as to form a loop.

Figure 13C:
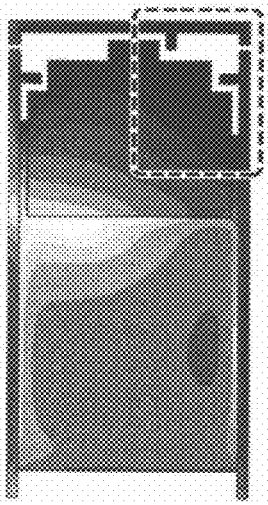

FIG. 13C illustrates a current distribution when 1.6 GHz power included in a 1.5 GHz frequency band of the communication frequency f3 is radiated. In order for the line path between the connection portion 141 and the end 142 of the radiation element 140 to perform communication at 1.6 GHz by being coupled to the radiation element 110 and fed with power, as illustrated by a dashed line, the line path between the connection portion 141 and the end 142 of the radiation element 140, the right side of the power feed point 111 in the radiation element 110, and the end side 50A of the ground plane 50M have a higher current value so as to form a loop. It is seen that the current distribution in FIG. 13C is slightly different from the current distribution illustrated in FIG. 13B.

Figure 13D:
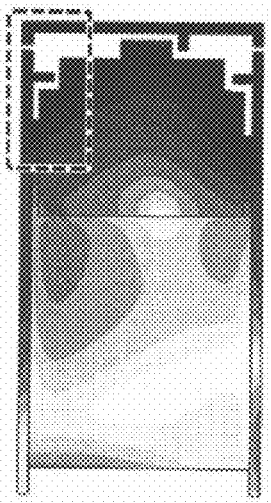

FIG. 13D illustrates a current distribution when 1.8 GHz (communication frequency f6) power is radiated. In order for the line path between the connection portion 151M and the end 152 of the radiation element 150M to perform communication at 1.8 GHz by being coupled to the radiation element 110 and fed with power, as illustrated by a dashed line, the line path between the connection portion 151M and the end 152 of the radiation element 150M has a higher current value.

Figure 13E:
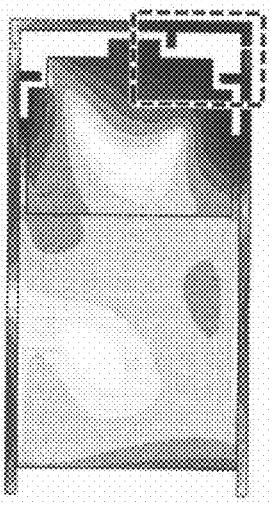

FIG. 13E illustrates a current distribution when 2 GHz (communication frequency f1) power is fed to the power feed point 111. In order for the section including the power feed point 111, the branch point 112, the bent portion 113, and the end 114 of the radiation element 110 to perform communication at 2 GHz, as illustrated by a dashed line, the current value is higher on the right side of the power feed point 111 in the radiation element 110.

Figure 14A:
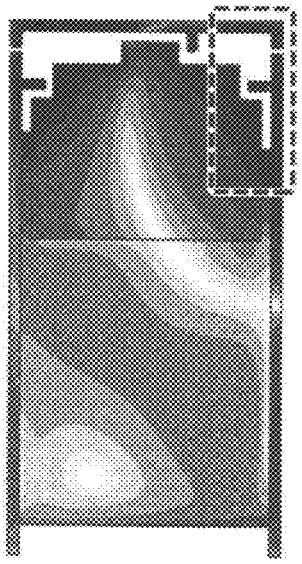
FIGS. 14A-14D illustrate simulation results of a current distribution of the wireless communication device.

FIG. 14A illustrates a current distribution when 2.4 GHz (communication frequency f4) power is fed from the power feed circuit 160 to the end 144 of the radiation element 140 via the cutoff circuit 170. In order for the section including the end 144, the branch point 143, and the connection portion 141 of the radiation element 140 to perform communication at 2.4 GHz, as illustrated by a dashed line, the current value is higher mainly on the lower side of the branch point 143 in the radiation element 140, and along the end side of the ground plane 50M.

Figure 14B:
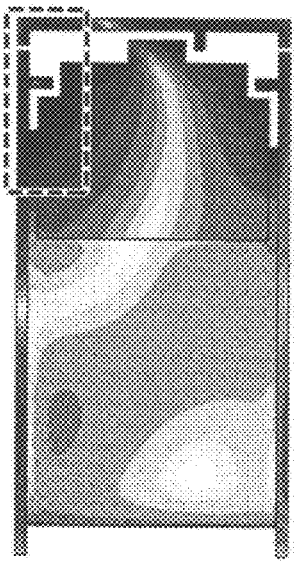

FIG. 14B illustrates a current distribution when 2.4 GHz (communication frequency f7) power is fed from the power feed circuit 160 to the end 154 of the radiation element 150M via the cutoff circuit 170. In order for the section including the end 154, the branch point 153, and the connection portion 151M of the radiation element 150M to perform communication at 2.4 GHz, as illustrated by a dashed line, the current value is higher mainly on the lower side of the branch point 153 in the radiation element 150M, and along the end side of the ground plane 50M.

Figure 14C:
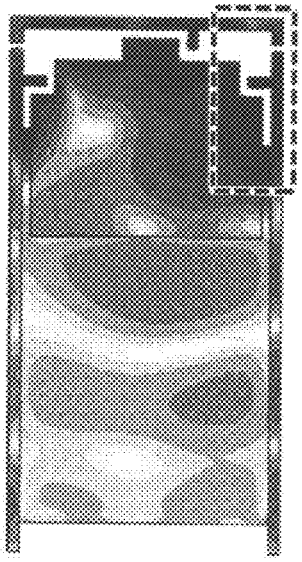

FIG. 14C illustrates a current distribution when 5 GHz (communication frequency f5) power is fed from the power feed circuit 160 to the end 144 of the radiation element 140 via the cutoff circuit 170. In order for the section including the end 144, the branch point 143, and the end 142 of the radiation element 140 to perform communication at 5 GHz, as illustrated by a dashed line, the current value is higher mainly on the upper side of the branch point 143 in the radiation element 140, and along the end side of the ground plane 50M.

Figure 14D:
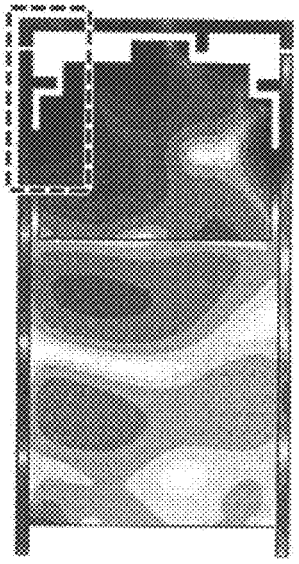

FIG. 14D illustrates a current distribution when 5 GHz (communication frequency f8) power is fed from the power feed circuit 160 to the end 154 of the radiation element 150M via the cutoff circuit 170. In order for the section including the end 154, the branch point 153, and the end 152 of the radiation element 150M to perform communication at 5 GHz, as illustrated by a dashed line, the current value is higher mainly on the upper side of the branch point 153 in the radiation element 150M, and along the end side of the ground plane 50M.

As described above, it has been verified that it is possible to perform the following eight types of communication in six frequency bands: 2 GHz (communication frequency f1) of the radiation element 110, 800 MHz (communication frequency f2) of the radiation element 110, 1.5 GHz (communication frequency f3) of the radiation element 140, 2.4 GHz (communication frequency f4) of the radiation element 140, 5 GHz (communication frequency f5) of the radiation element 140, 1.8 GHz (communication frequency f6) of the radiation element 150M, 2.4 GHz (communication frequency f7) of the radiation element 150M, and 5 GHz (communication frequency f8) of the radiation element 150M.

Among these, the communication frequencies f3, f4, f5, f6, f7, and f8 are achieved by the radiation elements 140 and 150M of the wireless communication device 100M, which serve as a parasitic element as well as a feed element. Also, here, the embodiment has been described in which the radiation elements 140 and 150M both perform communication at 2.4 GHz and 5 GHz as the MIMO antennas.

However, when the length between the connection portion 141 and the branch point 143 of the radiation element 140, the length between the end 142 and the branch point 143 of the radiation element 140, the length between the connection portion 151M and the branch point 153 of the radiation element 150M, and the length between the end 152 and the branch point 153 of the radiation element 150M are made different, a MIMO antenna is no longer achieved. In this case, it is possible to perform communication in totally eight frequency bands.

The multiple conductive members of the conventional mobile terminal are a first radiation member fed with power by a first power feed unit and a second radiation member fed with power by a second power feed unit, but the first radiation member and the second radiation member are each a radiation member having one frequency band for communication. In short, the first radiation member and the second radiation member are each a radiation member corresponding to one frequency band.

Thus, it is aimed to provide a wireless communication device capable of communicating in more frequency bands.

According to the embodiment above, the radiation elements 140 and 150M of the wireless communication device 100M both serve as a parasitic element and a feed element, thereby making it possible to increase the number of frequency bands which allow communication without increasing the number of radiation elements, as compared with the case where instead of the radiation elements 140 and 150M, the wireless communication device 100 includes two radiation elements, each of which serves as one of a parasitic element and a feed element.

Therefore, it is possible to provide the wireless communication device 100M capable of performing communication in more frequency bands.

Also, the radiation elements 140 and 150M both serve as a parasitic element and a feed element, thereby making it possible to perform communication in more frequency bands without increasing the number of radiation elements and ensuring a space for installing an additional radiation element.

Although the embodiment has been described in which the lengths of the slits 120B, 120C are different, the lengths of the slits 120B, 120C may be the same.

The embodiment has been described above in which from the viewpoint of capability of communication in more frequency bands, the radiation elements 140, 150M both serve as a parasitic element and a feed element. But the mobile terminal described in Japanese Laid-open Patent Publication No. 2015-109642 includes multiple conductive members formed on one surface of the second case, which operate as radiators of an antenna along with the frame section.

Providing multiple conductive members inwardly of the frame section in this manner is not preferable in the sense that space is not used effectively in an electronic device, such as a mobile terminal, which has limited internal space.

Thus, the radiation elements 140 and 150M of the wireless communication device 100M may not be connected to the cutoff circuits 170A, 170B and the power feed circuit 160, but be connected to only the impedance components 181A, 181B, 182A, and 182B, and the radiation elements 140 and 150M may serve as parasitic elements without feeding power.

In this case, 2.4 GHz (communication frequency f4) of the radiation element 140, 5 GHz (communication frequency f5) of the radiation element 140, 2.4 GHz (communication frequency f7) of the radiation element 150M, and 5 GHz (communication frequency f8) of the radiation element 150M are no longer available.

Since the conditions in this case differ from the case where power is fed to the radiation elements 140 and 150M, the impedances of the impedance components 181A, 181B, 182A, and 182B may be each set to an optimal value so that the radiation elements 140 and 150M operate only as the parasitic elements.

FIGS. 15A to 15E illustrate simulation results of current distribution of the wireless communication device 100M. In FIG. 15A to 15E, similarly to FIG. 7A to 7E and FIG. 8A to 8D, a current distribution is illustrated by gray scale. In FIG. 15, the outline of the wireless communication device 100M corresponding to FIG. 10 is illustrated, and symbols are omitted.

Figure 15A:
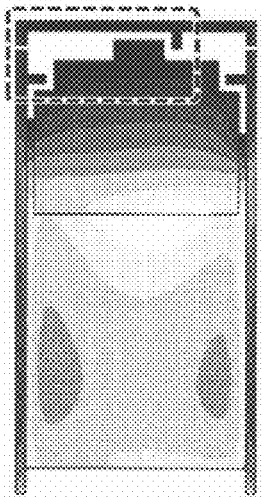
FIGS. 15A-15E illustrate simulation results of a current distribution of the wireless communication device.

FIG. 15A illustrates a current distribution when 800 MHz (communication frequency f2) power is fed to the power feed point 111. In order for the section including the power feed point 111, the branch point 112, the bent portion 115, and the end 116 of the radiation element 110 to perform communication at 800 MHz, as illustrated by a dashed line, the current value is higher on the left side of the power feed point 111 in the radiation element 110.

Figure 15B:
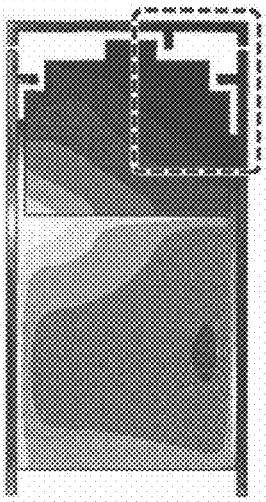

FIG. 15B illustrates a current distribution when 1.5 GHz (communication frequency f3) power is radiated. In order for the line path between the connection portion 141 and the end 142 of the radiation element 140 to perform communication at 1.5 GHz by being coupled to the radiation element 110 and fed with power, as illustrated by a dashed line, the line path between the connection portion 141 and the end 142 of the radiation element 140, the right side of the power feed point 111 in the radiation element 110, and the end side 50A of the ground plane 50M have a higher current value so as to form a loop.

Figure 15C:
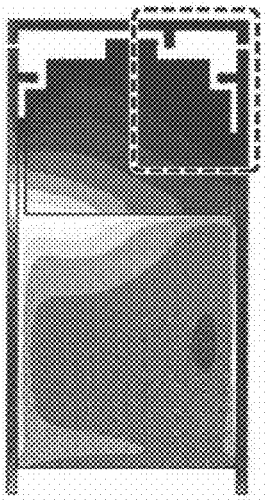

FIG. 15C illustrates a current distribution when 1.6 GHz power included in a 1.5 GHz frequency band of the communication frequency f3 is radiated. In order for the line path between the connection portion 141 and the end 142 of the radiation element 140 to perform communication at 1.6 GHz by being coupled to the radiation element 110 and fed with power, as illustrated by a dashed line, the line path between the connection portion 141 and the end 142 of the radiation element 140, the right side of the power feed point 111 in the radiation element 110, and the end side 50A of the ground plane 50M have a higher current value so as to form a loop. It is seen that the current distribution in FIG. 15C is slightly different from the current distribution illustrated in FIG. 15B.

Figure 15D:
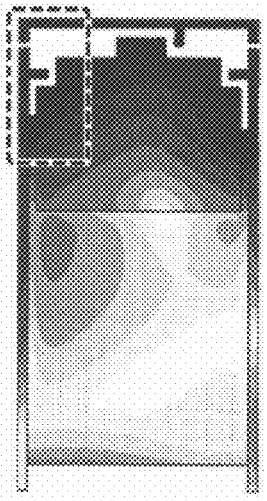

FIG. 15D illustrates a current distribution when 1.8 GHz (communication frequency f6) power is radiated. In order for the line path between the connection portion 151M and the end 152 of the radiation element 150M to perform communication at 1.8 GHz by being coupled to the radiation element 110 and fed with power, as illustrated by a dashed line, the line path between the connection portion 151M and the end 152 of the radiation element 150M has a higher current value.

Figure 15E:
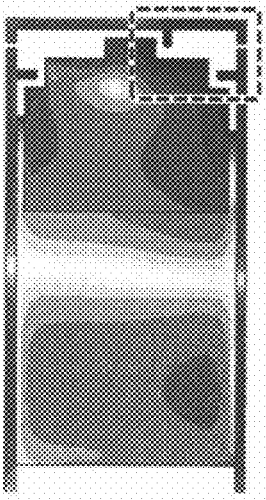

FIG. 15E illustrates a current distribution when 2 GHz (communication frequency f1) power is fed to the power feed point 111. In order for the section including the power feed point 111, the branch point 112, the bent portion 113, and the end 114 of the radiation element 110 to perform communication at 2 GHz, as illustrated by a dashed line, the current value is higher on the right side of the power feed point 111 in the radiation element 110.

As described above, when the radiation elements 140 and 150M serve as parasitic elements without feeding power, the conditions for the case where power is fed to the radiation elements 140 and 150M are changed, and the values of impedances of the impedance components 181A, 181B, 182A, and 182B are changed. Thus, as illustrated in FIGS. 15A to 15E, a current distribution slightly different from the current distribution illustrated in FIGS. 13A to 13E is obtained, but substantially similar tendency has been verified.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A wireless communication device comprising:

a ground plane that has a first end side and is disposed inside a housing;

a first radiation element that is fed with power at a power feed point located in a vicinity of the first end side, has a first line path which is exposed to an outer peripheral portion of the housing and extends between a first end and a second end, and performs communication at a first communication frequency;

a sheet metal connected to the ground plane;

a second radiation element that includes a second line path and a third line path, and is coupled to the first radiation element and resonates with a second communication frequency, the second line path being exposed from a first connection portion connected to the sheet metal to the outer peripheral portion of the housing, and extending to a third end located in a vicinity of the first end, the third line path branching from a first point between the first connection portion and the third end of the second line path and extending to a fourth end located internally of the housing, a length of the second line path being a quarter wavelength of an electrical length of a second wave length of the second communication frequency, one of a first length from the third end to the fourth end through the first point and a second length from the first connection portion to the fourth end through the first point being a quarter wavelength of an electrical length of a third wave length of a third communication frequency;

a first cutoff circuit that is connected to the fourth end and cuts off the second communication frequency; and a first power feed circuit that is connected to the fourth end via the first cutoff circuit, and feeds power at the third communication frequency to the fourth end.

2. The wireless communication device according to claim 1, wherein the first radiation element is a T-shaped antenna element further including a fourth line path that extends from the power feed point to a second point between the first end and the second end of the first line path, and a total length of a first section between the first end and the second point of the first line path, and the fourth line path is a quarter wavelength of an electrical length of a first wave length of the first communication frequency, and a total length of a second section between the second end and the second point of the first line path, and the fourth line path is a quarter wavelength of an electrical length of a fourth wave length of a fourth communication frequency.

3. The wireless communication device according to claim 1, wherein the other of the first length and the second length of the second radiation element is a quarter wavelength of an electrical length of a fifth wave length of a fifth communication frequency, and the first power feed circuit feeds power at the fifth communication frequency to the fourth end in addition to power at the third communication frequency.

4. The wireless communication device according to claim 1, further comprising:

a third radiation element that includes a fifth line path and a sixth line path, and is coupled to the first radiation element and resonates with a sixth communication frequency, the fifth line path being exposed from a second connection portion connected to the sheet metal to the outer peripheral portion of the housing, and extending to a fifth end located in a vicinity of the second end, the sixth line path branching from a third point between the second connection portion and the fifth end of the fifth line path and extending to a sixth end located internally of the housing, a length of the fifth line path being a quarter wavelength of an electrical length of a sixth wave length of the sixth communication frequency, one of a third length from the fifth end to the sixth end through the third point and a fourth length from the second connection portion to the sixth end through the third point being a quarter wavelength of an electrical length of a seventh wave length of a seventh communication frequency;

a second cutoff circuit that is connected to the sixth end and cuts off the sixth communication frequency; and a second power feed circuit that is connected to the sixth end via the second cutoff circuit, and feeds power at the seventh communication frequency to the sixth end.

5. The wireless communication device according to claim 4, wherein the other of the third length and the fourth length of the third radiation element is a quarter wavelength of an electrical length of an eighth wave length of an eighth communication frequency, and the second power feed circuit feeds power at the eighth communication frequency to the sixth end in addition to power at the seventh communication frequency.

6. The wireless communication device according to claim 4, further comprising:

a first metal plate that includes a third connection portion connected to the first connection portion of the second radiation element, extends from the third connection portion in an opposite direction to the second line path, and is exposed to the outer peripheral portion of the housing; and a second metal plate that includes a fourth connection portion connected to the second connection portion of the third radiation element, extends from the fourth connection portion in an opposite direction to the fifth line path, and is exposed to the outer peripheral portion of the housing.

7. The wireless communication device according to claim 6, wherein the first metal plate and the second metal plate are formed integrally with the sheet metal.

8. The wireless communication device according to claim 4, wherein the housing is a rectangular thin plate-shaped housing in a plan view, and the first line path of the first radiation element, the second line path of the second radiation element, and the fifth line path of the third radiation element are exposed to lateral surfaces for a front surface and a back surface of the housing corresponding to a front surface and a back surface of the sheet metal, respectively.

9. The wireless communication device according to claim 1, wherein the sheet metal includes:

a second end side that is nearer to the first connection portion than the third line path of the second radiation element; and a first slit that is cut from the second end side to a seventh end along the second line path, wherein the first connection portion of the second radiation element is at a same position as the seventh end in a direction in which the first slit extends.

10. The wireless communication device according to claim 4, wherein the sheet metal includes:

a second end side that is nearer to the second connection portion than the sixth line path of the third radiation element; and a second slit that is cut from the second end side to an eighth end along the fifth line path, wherein the second connection portion of the third radiation element is at a same position as the eighth end in a direction in which the second slit extends.

* * * * *